US007618129B2

(12) United States Patent
Kodama et al.

(10) Patent No.: US 7,618,129 B2
(45) Date of Patent: Nov. 17, 2009

(54) LIQUID EJECTION HEAD AND IMAGE FORMING APPARATUS COMPRISING SAME

(75) Inventors: Kenichi Kodama, Kanagawa (JP); Toshiya Kojima, Kanagawa (JP); Kazuo Sanada, Kanagawa (JP); Tsuyoshi Mita, Kanagawa (JP); Seiichiro Oku, Kanagawa (JP); Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 399 days.

(21) Appl. No.: 11/225,183

(22) Filed: Sep. 14, 2005

(65) Prior Publication Data

US 2006/0055743 A1 Mar. 16, 2006

(30) Foreign Application Priority Data

Sep. 15, 2004 (JP) ..... 2004-268545

(51) Int. Cl.
*B41J 2/045* (2006.01)
*B41J 2/05* (2006.01)

(52) U.S. Cl. ..... 347/68; 347/59

(58) Field of Classification Search ..... 347/59, 347/68, 70–72

See application file for complete search history.

(56) References Cited

U.S. PATENT DOCUMENTS 6,109,736 A * 8/2000 Miyata et al. ..... 347/68
6,488,355 B2 12/2002 Nakamura et al.
6,666,547 B1 * 12/2003 Takahashi et al. ..... 347/70
6,808,254 B2 10/2004 Sakaida et al.
2002/0018095 A1 2/2002 Nakamura et al.
2002/0080215 A1 6/2002 Sakaida et al.
2003/0103118 A1 6/2003 Watanabe et al.
2003/0122902 A1 7/2003 Sakaida et al.
2003/0156164 A1 8/2003 Sakaida et al.
2004/0041885 A1 3/2004 Hirota
2004/0090498 A1 5/2004 Sakaida et al.

FOREIGN PATENT DOCUMENTS

JP 2001-334661 A 12/2001
JP 2002-166543 A 6/2002

* cited by examiner

*Primary Examiner*—An H Do
(74) *Attorney, Agent, or Firm*—Birch, Stewart, Kolasch & Birch, LLP

(57) ABSTRACT

The liquid ejection head includes: a nozzle plate which has a plurality of ejection apertures through which a liquid is ejected; a plurality of pressure chambers which are connected respectively to the ejection apertures; a plurality of liquid supply flow channels which supply the liquid respectively to the pressure chambers; a common liquid chamber which supplies the liquid to the liquid supply flow channels; a plurality of pressure generating devices which respectively deform the pressure chambers; and a plurality of electrical wires which supply drive signals to the pressure chamber generating devices, wherein the electrical wires are provided so as to pass through the common liquid chamber.

14 Claims, 19 Drawing Sheets

FIG.20

| INK VISCOSITY | $\eta$ (cP) | 20 | | 2 | |
|---|---|---|---|---|---|
| SUPPLY RESTRICTOR | | ABSENCE | PRESENCE | ABSENCE | PRESENCE |
| PIEZO THICKNESS | ($\mu$m) | 10 | | | |
| DIAPHRAGM THICKNESS | ($\mu$m) | 10 | | | |
| PRESSURE CHAMBER SIZE (DEPTH) | ($\mu$m) | 300 | | | |
| (WIDTH) | ($\mu$m) | 300 | | | |
| (HEIGHT) | ($\mu$m) | 150 | | | |
| ACTUATOR COMPLIANCE | Cp ($m^3$/Pa) | 1.00E-20 | | | |
| PRESSURE CHAMBER COMPLIANCE | Cc ($m^3$/Pa) | 1.11E-20 | | | |
| RESONANCE PERIOD | Tc ($\mu$s) | 3.5 | 4.8 | 3.4 | 4.5 |
| EJECTION SPEED | Uave (m/s) | 12.3 | 12.8 | 14.7 | 18.7 |
| (NOZZLE)/(NOZZLE + SUPPLY) VOLUME RATIO | | 0.28 | 0.54 | 0.31 | 0.53 |
| ACTUATOR DISPLACEMENT VOLUME | $\Delta$W (pl) | 20 | 20 | 14 | 14 |
| $1+\exp(-\pi D/\omega)$ | | 1.79 | 1.32 | 1.97 | 1.90 |
| NOZZLE SIDE RESISTANCE | Rn (Pa · s/$m^3$) | 4.13E+13 | | 4.13E+12 | |
| NOZZLE SIDE INERTANCE | Mn (kg/$m^4$) | 4.55E+07 | | | |
| SUPPLY SIDE RESISTANCE | Rs (Pa · s/$m^3$) | 1.14E+12 | 5.20E+13 | 1.14E+11 | 5.20E+12 |
| SUPPLY SIDE INERTANCE | Ms (kg/$m^4$) | 2.00E+07 | 5.18E+07 | 2.00E+07 | 5.18E+07 |

[SHAPE OF RESTRICTOR]

| | | RESTRICTOR |
|---|---|---|
| LENGTH (m) | l | 10E-6 |
| RADIUS (m) | r | 10E-6 |

[SHAPE OF NOZZLE]

TAPERED FLOW CHANNEL

| | | NOZZLE |
|---|---|---|
| LENGTH (m) | l | 30E-6 |
| RADIUS (m) | r1 (EJECTION) | 10E-6 |
| | r2 | 21E-6 |
| CROSS-SECTIONALAREA ($m^2$) (EJECTION) | S | 3.14E-10 |
| ANGLE OF TAPER (° ) | | 20 |

LIQUID EJECTION HEAD AND IMAGE FORMING APPARATUS COMPRISING SAME

BACKGROUND OF THE INVENTION

1. Field of the Invention

The present invention relates to a liquid ejection head and an image forming apparatus comprising same, and more particularly to a liquid ejection head and an image forming apparatus comprising same that can achieve a high-density arrangement of ejection ports ejecting a liquid while also permitting ejection of high-viscosity liquid.

2. Description of the Related Art

Conventionally, as an image forming apparatus, an inkjet printer (inkjet recording apparatus) is known which comprises an inkjet head (liquid ejection head) having an arrangement of a plurality of nozzles (ejection ports) and which records images on a recording medium by ejecting ink from the nozzles toward the recording medium while causing the inkjet head and the recording medium to move relatively to each other.

In the inkjet printer of this kind, ink is supplied to pressure chambers from an ink tank via an ink supply channel, and piezoelectric elements are driven by supplying electrical signals corresponding to the image data to the piezoelectric elements. Thereby, the diaphragm constituting a portion of each pressure chamber is deformed, the volume of the pressure chamber is deformed, and the ink inside the pressure chamber is ejected from a nozzle in the form of a droplet.

In the inkjet recording printer, one image can be formed on a recording by combining dots formed by ink ejected from the nozzles. In recent years, it has become desirable to form images of high-quality on a par with photographic prints, according to inkjet printers. It has been considered that high image quality can be achieved by reducing the size of the ink droplets ejected from the nozzles by reducing the diameter of the nozzles, while also increasing the number of pixels per image by arranging the nozzles at high density. As a method of increasing the density of the nozzle arrangement, conventionally, it has been proposed that nozzles be arranged in a two-dimensional matrix array.

For example, it is known in which a plurality of nozzles are arranged in the form of a lattice comprising a plurality of rows inclined at an uniform angle with respect to the main scanning direction of the head and a plurality of columns perpendicular to the main scanning direction of the head, and that the planar shape of the diaphragm which constitutes one surface of the pressure chambers provided respectively corresponding to each nozzle is formed to an approximately square shape or diamond shape. Thereby, it is possible to increase the ejection efficiency of the pressure chambers, and to arrange the nozzles at high density (see Japanese Patent Application Publication No. 2001-334661, for example).

Furthermore, a technology is also known in which pressure chambers provided in a cavity plate are formed in an approximate diamond shape, an ink supply port being formed in one of the acute corner sections of each pressure chamber, and an ink ejection nozzle being formed in the other acute corner section of same. Thereby, since a plurality of ink pressure chambers are arranged corresponding to a plurality of nozzles without increasing the dimensions of the cavity plate, high density of the nozzles can be achieved (see Japanese Patent Application Publication No. 2002-166543, for example).

However, when the density of the nozzles is increased by the inkjet head having a composition described in the aforementioned references, there are problems such as described below. Therefore, it is difficult to achieve efficient ink ejection if the nozzles are arranged at high density in the composition of this kind, in practice.

More specifically, in a composition which ejects ink from one nozzle of an inkjet head as disclosed in the aforementioned references, the common ink flow channel, supply channel, pressure chamber and nozzle are all disposed on the same one side of the diaphragm which forms one surface of the pressure chamber, and the piezoelectric actuator is disposed on the opposite side thereof in the diaphragm.

For example, if the density of the nozzles is increased in a composition of this kind, then the size of the common flow channel gradually decreases as the density thereof rises. Therefore, when the ink is ejected by driving a plurality of nozzles at high frequency, the ink supply to the pressure chambers may not be sufficient. In this case, if the common flow channel is increased in size in order to obtain a smooth supply of ink, then the actual ejection operation may become difficult to perform, due to the increased distance between the pressure chamber and the nozzle. Consequently, there is a problem in which the ejection frequency cannot be raised due to structural limitations on the size of the common flow channel.

In addition, if the ink of low viscosity is used, then the ink landing on the recording medium permeates rapidly into the recording medium, thereby giving rise to bleeding, which leads to degraded image quality. Therefore, it is desirable to use high-viscosity ink from the viewpoint of preventing bleeding of this kind. However, when a high-viscosity ink is used in a head having nozzles arranged at high density as described above, there is a problem in which the ink is supplied more slowly to the pressure chambers due to the reasons described above, and hence the ejection frequency becomes even lower.

SUMMARY OF THE INVENTION

The present invention is contrived in view of such circumstances, and an object thereof is to provide a liquid ejection head and an image forming apparatus comprising same that can permit driving of high-frequency, in particular, ejection of high-viscosity liquid, even if high density of the liquid ejection aperture is achieved, thereby achieving a higher density of arrangement of the electrode wiring and the liquid ejection aperture.

In order to attain the aforementioned object, the present invention is directed to a liquid ejection head, comprising: a nozzle plate which has a plurality of ejection apertures through which a liquid is ejected; a plurality of pressure chambers which are connected respectively to the ejection apertures; a plurality of liquid supply flow channels which supply the liquid respectively to the pressure chambers; a common liquid chamber which supplies the liquid to the liquid supply flow channels; a plurality of pressure generating devices which respectively deform the pressure chambers; and a plurality of electrical wires which supply drive signals to the pressure chamber generating devices, wherein the electrical wires are provided so as to pass through the common liquid chamber.

According to the present invention, since the wires of the pressure generating devices are positioned so as to pass through the common liquid chamber (by rising up the wires in a substantially perpendicular direction), it is possible to minimize the space needed to wiring inside the common liquid chamber. Therefore, the density of the ejections apertures can be increased, and the flow channel resistance of the common liquid chamber can be reduced.

The present invention is also directed to the liquid ejection head wherein the pressure generating devices are piezoelectric elements.

The present invention is also directed to the liquid ejection head wherein: the pressure generating devices are disposed on an opposite side to the ejection apertures with respect to the pressure chambers; and the common liquid chamber is disposed on an opposite side to the pressure chambers with respect to the pressure generating devices.

According to the present invention, since the flexibility in designing the flow channels leading from the common liquid chamber to the pressure chambers is increased, the space on the ejection aperture side can be ensured. Therefore, since the flow channels from the pressure chambers to the ejection ports can be shortened accordingly, it is possible to increase the liquid ejection efficiency, and to eject liquids of high viscosity.

The present invention is also directed to the liquid ejection head wherein the liquid supply flow channels are formed substantially perpendicular to a surface of the pressure generating devices.

Accordingly, since a direct fluid connection can be created between the common liquid chamber and the pressure chamber, it is possible to refill swiftly even if a high-viscosity liquid is used. In addition, it is also possible to drive in higher-frequency.

The present invention is also directed to the liquid ejection head wherein the electrical wires are formed substantially perpendicular to a surface of the pressure generating devices.

According to the present invention, since a two-dimensional arrangement of electrodes can be achieved by this composition, the density of the wiring can be increased.

The present invention is also directed to the liquid ejection head wherein the pressure chambers are arranged in a two-dimensional matrix array.

Accordingly, the density of the ejection ports can be increased further highly.

The present invention is also directed to the liquid ejection head further comprising a wiring layer which is connected to the electrical wires, the wiring layer being disposed on an opposite side to the pressure generating devices with respect to the common liquid chamber.

Accordingly, it is possible to increase the flexibility of designing the wiring layer, and to increase the density of the wiring.

In order to attain the aforementioned object, the present invention is directed to an image forming apparatus, comprising a liquid ejection head which comprises: a nozzle plate which has a plurality of ejection apertures through which a liquid is ejected; a plurality of pressure chambers which are connected respectively to the ejection apertures; a plurality of liquid supply flow channels which supply the liquid respectively to the pressure chambers; a common liquid chamber which supplies the liquid to the liquid supply flow channels; a plurality of pressure generating devices which respectively deform the pressure chambers; and a plurality of electrical wires which supply drive signals to the pressure chamber generating devices, wherein the electrical wires are provided so as to pass through the common liquid chamber.

The present invention is also directed to the image forming apparatus wherein the pressure generating devices are piezoelectric elements.

The present invention is also directed to the image forming apparatus wherein: the pressure generating devices are disposed on an opposite side to the ejection apertures with respect to the pressure chambers; and the common liquid chamber is disposed on an opposite side to the pressure chambers with respect to the pressure generating devices.

The present invention is also directed to the image forming apparatus wherein the liquid supply flow channels are formed substantially perpendicular to a surface of the pressure generating devices.

The present invention is also directed to the image forming apparatus wherein the electrical wires are formed substantially perpendicular to a surface of the pressure generating devices.

The present invention is also directed to the image forming apparatus wherein the pressure chambers are arranged in a two-dimensional matrix array.

The present invention is also directed to the image forming apparatus further comprising a wiring layer which is connected to the electrical wires, the wiring layer being disposed on an opposite side to the pressure generating devices with respect to the common liquid chamber.

According to the present invention, it is possible to form images of high quality by means of a liquid ejection head formed in high density.

As described above, according to the present invention, it is possible to ensure sufficient space for the wiring through which supplies drive signals to the pressure generating devices, while increasing the density of the ejection apertures.

In addition, when the common liquid chamber is disposed opposite to the pressure chambers across the pressure generating devices, the size of supply flow channels can be increased, and high-frequency driving can be performed while also increasing the density of the ejection apertures. Furthermore, when the wiring layer is disposed above the common liquid chamber by using electrical wires, the wiring can be integrated with a driver chip, and therefore even higher density can be achieved.

Moreover, since the common liquid chamber is positioned opposite to the pressures chambers with respect to the pressure generating devices, it is possible to create a direct fluid connection between the liquid supply section and the pressure chambers. Therefore, swift refilling is possible even if a high-viscosity liquid is used, and ejection of high-viscosity liquid becomes easier to perform.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 20 is an illustrative diagram showing values of respective elements used for analyzing refill characteristics and ejection characteristics;

DETAILED DESCRIPTION OF THE PREFERRED EMBODIMENTS

Figure 1:
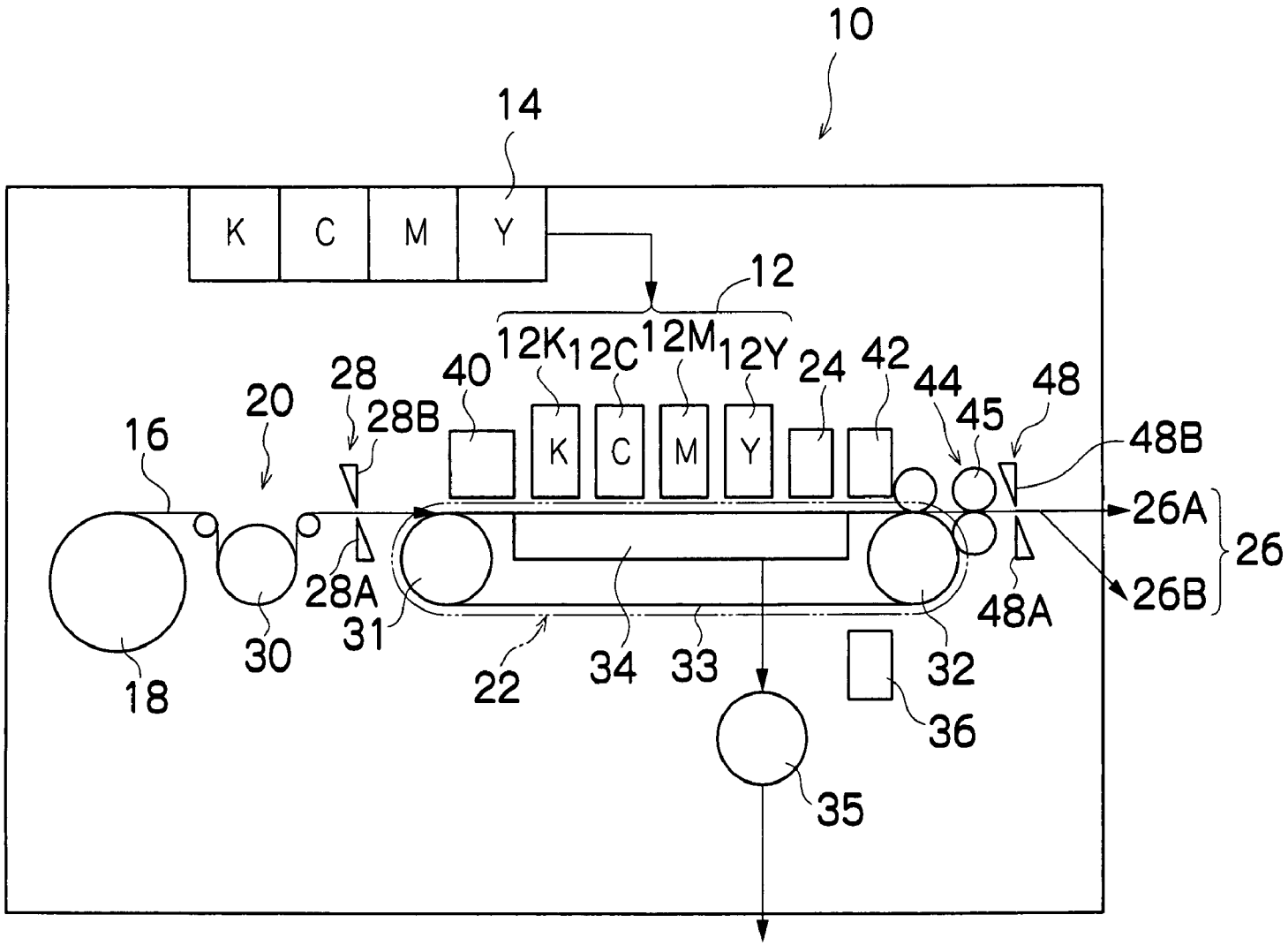
FIG. 1 is a general schematic drawing of an inkjet recording apparatus as an image forming apparatus according to an embodiment of the present invention.

FIG. 1 is a general schematic drawing of an inkjet recording apparatus as an image forming apparatus having a liquid ejection head according to an embodiment of the present invention.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M, and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
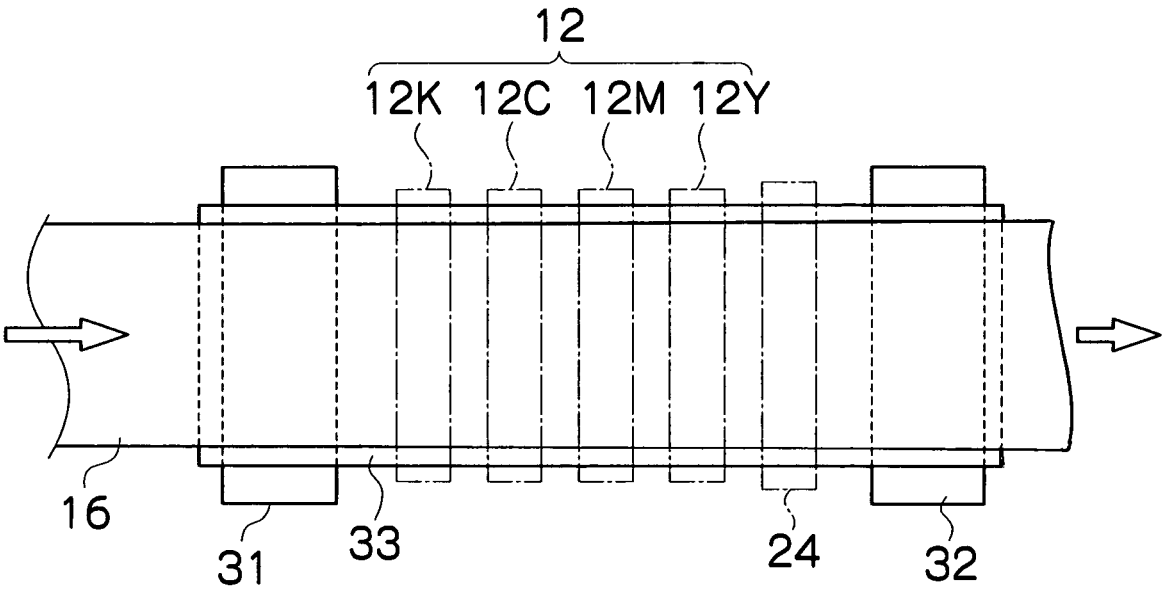
FIG. 2 is a principal plan view of the peripheral area of a printing unit in the inkjet recording apparatus shown in FIG. 1.

The printing unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, and 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in the direction (main scanning direction) which is perpendicular to the paper conveyance direction (sub-scanning direction).

Here, the terms "main scanning direction" and "sub-scanning direction" are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although a configuration with the four standard colors of K, C, M, and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, and 12Y, via a tube channel (not shown). Moreover, the ink storing and loading unit 14 also comprises a notifying device (display device, alarm generating device, or the like) for generating a notification if the remaining amount of ink has become low, as well as having a mechanism for preventing incorrect loading of the wrong colored ink.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor (line sensor).

The print determination unit 24 of the present embodiment is configured with at least a line sensor having rows of photoelectric conversion elements with a width that is greater than the ink-droplet ejection width (image recording width) of the print heads 12K, 12C, 12M, and 12Y. This line sensor has a color separation line CCD sensor including a red (R) sensor row composed of photoelectric conversion elements (pixels) arranged in a line provided with an R filter, a green (G) sensor row with a G filter, and a blue (B) sensor row with a B filter. Instead of a line sensor, it is possible to use an area sensor composed of photoelectric conversion elements which are arranged two-dimensionally.

The print determination unit 24 reads a test pattern image printed by the print heads 12K, 12C, 12M, and 12Y for the respective colors, and determines the ejection of each head. This ejection determination includes the presence of ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Figure 3:
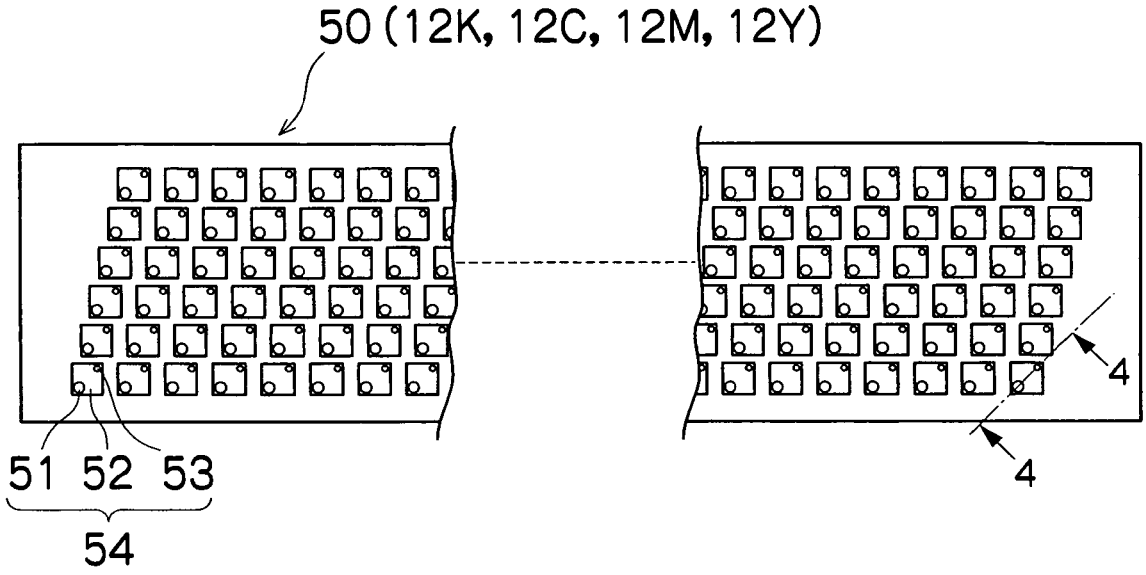
FIG. 3 is a plan perspective diagram showing an example of the structure of a print head.

Next, the arrangement of nozzles (liquid ejection ports) in the print head (liquid ejection head) will be described. The print heads 12K, 12C, 12M, and 12Y provided for the respective ink colors have the same structure, and a print head forming a representative example of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, respectively constituted by a nozzle for ejecting ink as ink droplets, a pressure chamber 52 for applying pressure to the ink in order to eject ink, and an ink supply port 53 for supplying ink to the pressure chamber 52 from a common flow channel (not shown in FIG. 3).

There is no particular limitation on the size of the nozzle arrangement in a print head 50 of this kind, but as one example, 2400 npi can be achieved by arranging nozzles 51 in 48 lateral rows (21 mm) and 600 vertical columns (305 mm).

In the example shown in FIG. 3, the pressure chambers 52 respectively have an approximately square planar shape when viewed from above, but the planar shape of the pressure chambers 52 is not limited to a square shape. As shown in FIG. 3, a nozzle 51 is formed at one end of the diagonal of each pressure chamber 52, and an ink supply port 53 is provided at the other end thereof.

Figure 4:
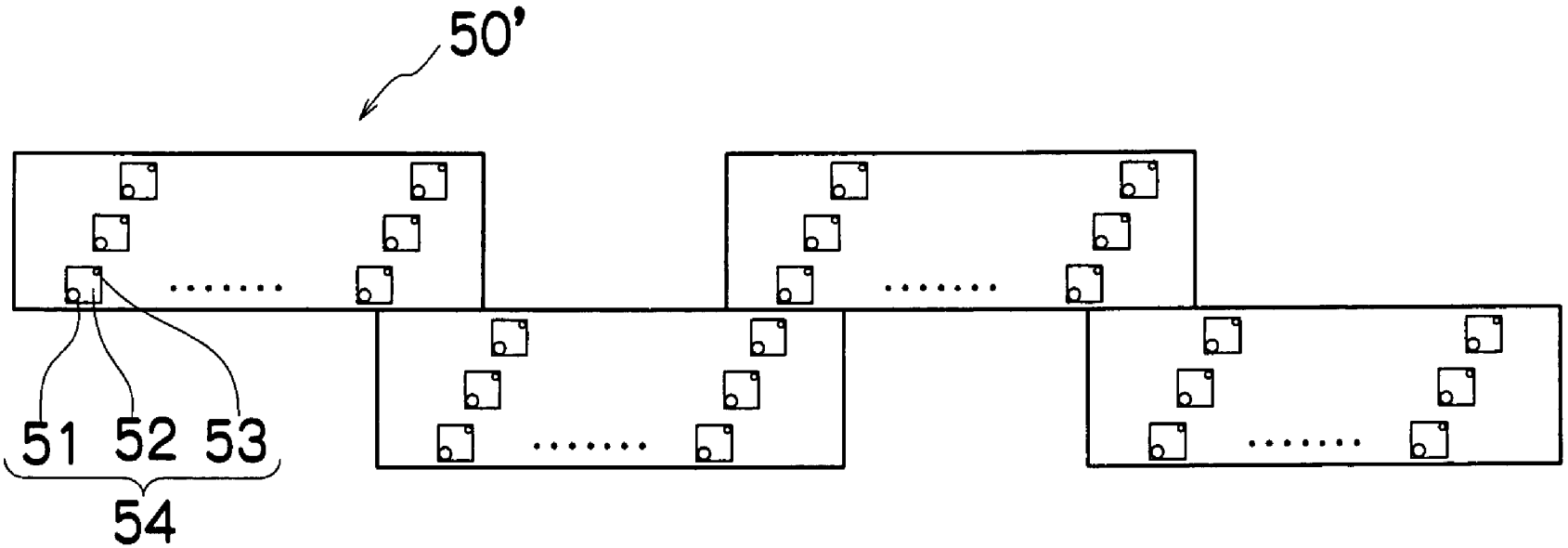
FIG. 4 is a plan view showing another example of a print head.

FIG. 4 is a plan view perspective diagram showing another example of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
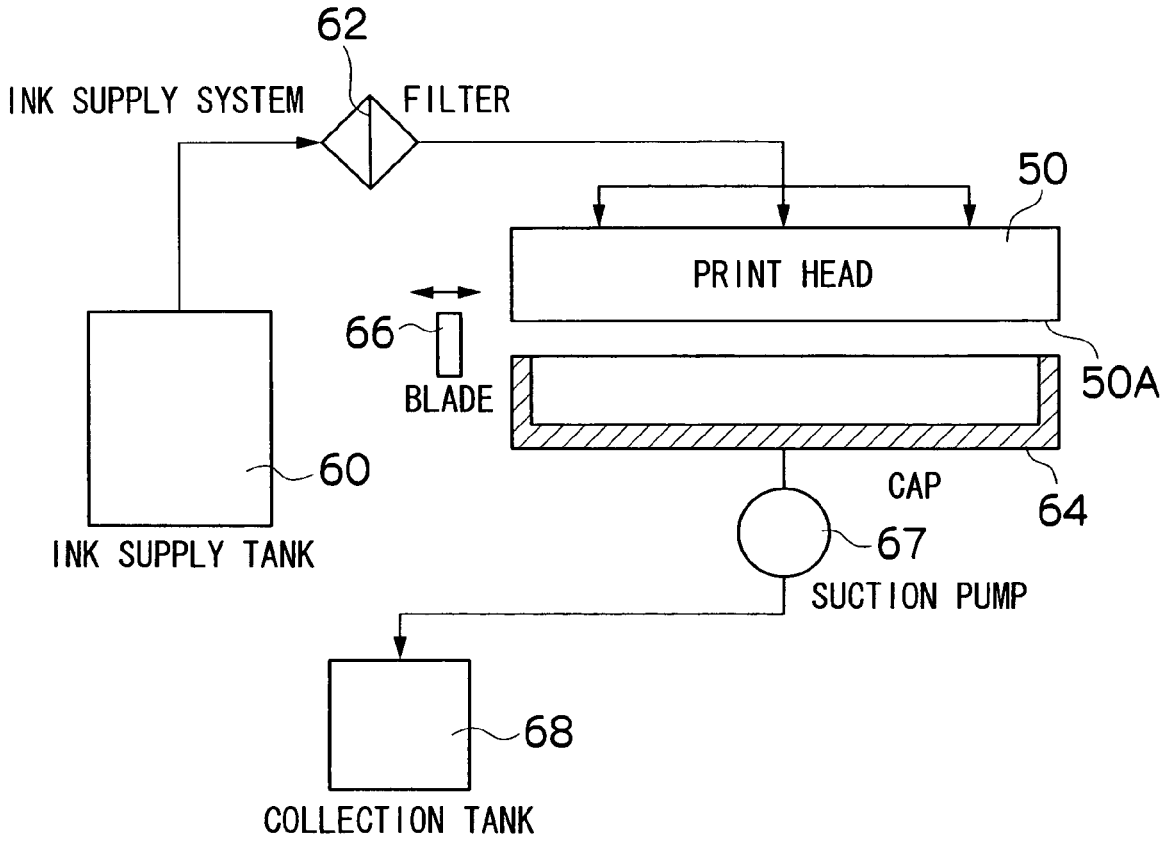
FIG. 5 is a schematic drawing showing the composition of an ink supply system in the inkjet recording apparatus according to the embodiment.

FIG. 5 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed at an intermediate position of the tube channel which connects the ink tank 60 with the print head 50 as shown in FIG. 5. The filter mesh size in the filter 62 is preferably equivalent to or less than the diameter of the nozzle of the print head 50 and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head 50.

The inkjet recording apparatus 10 is also provided with a cap 64 as a device to prevent the nozzles from drying out or to prevent an increase in the ink viscosity in the vicinity of the nozzles 51, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced upwards and downwards in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle face 50A is thereby covered by the cap 64.

The cleaning blade 66 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed in the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by suction is sent to a collection tank 68. This suction operation is also carried out in order to suction and remove degraded ink which has hardened due to increasing in viscosity when ink is loaded into the head for the first time, and when the head starts to be used after having been out of use for a long period of time.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the pressure generating devices (not shown, but described later) for driving ejection are operated. Therefore, before a state of this kind is reached (while the ink is in a range of viscosity which allows ink to be ejected by means of operation of the pressure generating devices), a "preliminary ejection" is carried out, whereby the pressure generating devices are operated and the ink in the vicinity of the nozzles, which is of raised viscosity, is ejected toward the ink receptacle. Furthermore, after cleaning away soiling on the surface of the nozzle surface 50A by means of a wiper, such as a cleaning blade 66, provided as a cleaning device on the nozzle surface 50A, a preliminary ejection is also carried out in order to prevent infiltration of foreign matter inside the nozzles 51 due to the rubbing action of the wiper. The preliminary ejection is also referred to as "dummy ejection", "purge", "liquid ejection", and so on.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed into the ink inside the nozzles 51 and the pressure chambers 52, ink can no longer be ejected from the nozzles even if the laminated pressure generating devices are operated. In a case of this kind, a cap 64 is placed on the nozzle surface 50A of the print head 50, and the ink containing air bubbles or the ink of increased viscosity inside the pressure chambers 52 is suctioned by a pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor. The cap 64 shown in FIG. 5 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 6:
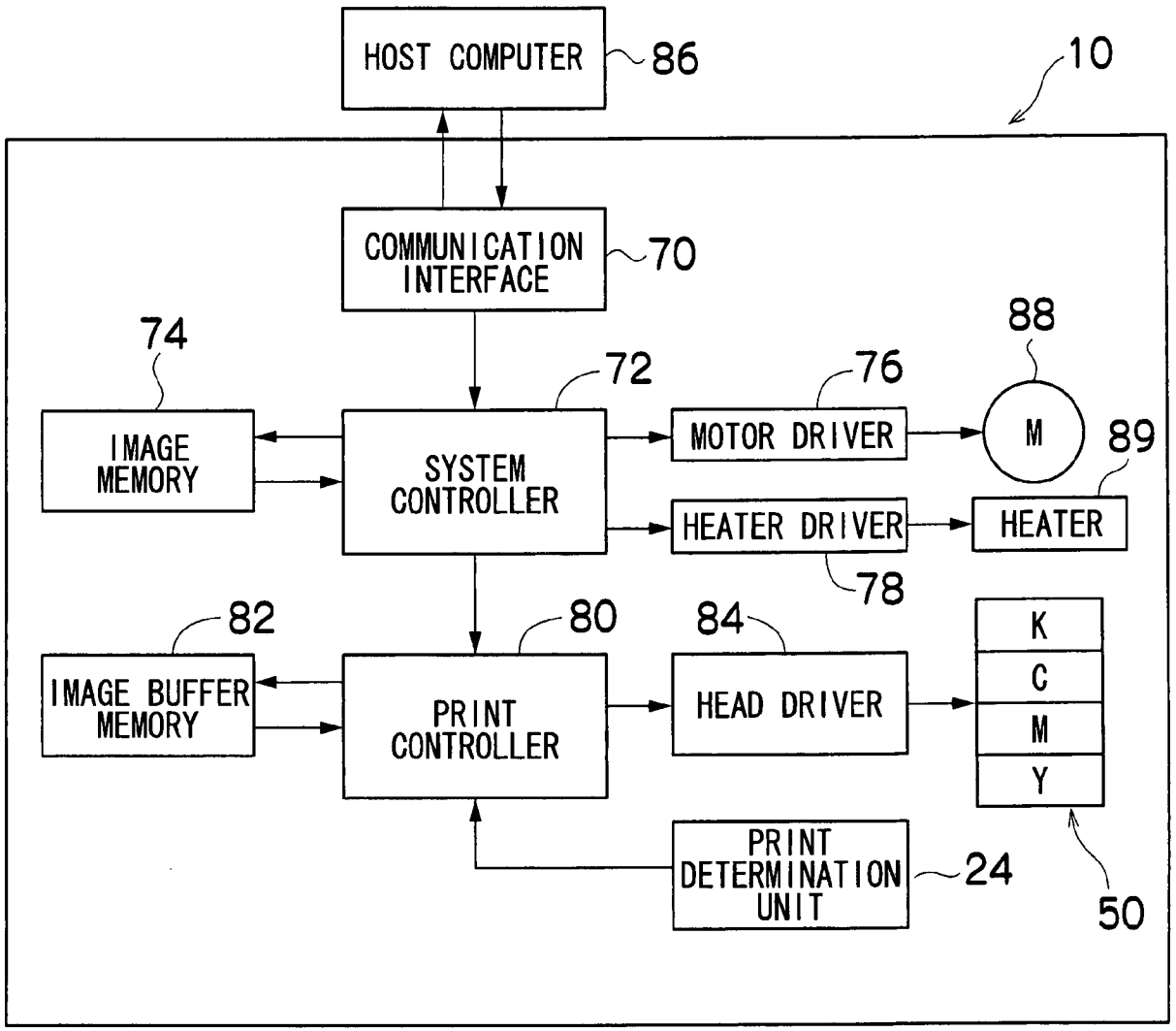
FIG. 6 is a principal block diagram showing the system composition of an inkjet recording apparatus according to the embodiment.

FIG. 6 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the pressure generating devices of the print heads 50 of the respective colors KCMY according to print data supplied by the print controller 80. The head driver 84 can be provided with a feedback control system for maintaining constant drive conditions for the print heads.

The print determination unit 24 is a block that includes the line sensor (not shown) as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the print head 50 on the basis of information obtained from the print determination unit 24.

Next, as one of the characteristics according to the present invention, a detailed description is given relating to a liquid ejection head (print head 50) that can drive ejection at high frequency and eject ink of high viscosity even if the nozzles, the ink supply system, and the wiring which supplies the drive signals are arranged at high density.

In a first embodiment of the present invention, in order to achieve high density in a print head of this kind, firstly, a high-density arrangement of nozzles 51 is obtained (for example, 2400 npi) by arranging pressure chambers 52 (nozzles 51) in the form of a two-dimensional matrix, as shown in FIG. 3 for example. Next, as described in more detail below, in the present embodiment, a common liquid chamber supplying ink to the pressure chambers 52 is disposed above the diaphragm, the ink is supplied directly from this common liquid chamber to the pressure chambers 52 for prioritizing ink refilling characteristics, and then a tubing which causes flow resistance is eliminated, so that the ink supply system is integrated to a high degree. Then, in the present embodiment, the electrical wiring which supplies drive signals to the electrodes (individual electrodes) of the pressure generating devices that deform the pressure chambers 52 is connected to upper wiring, such as a flexible cable, so as to rise upwards vertically from each individual electrode through the common liquid chamber.

Figure 7:
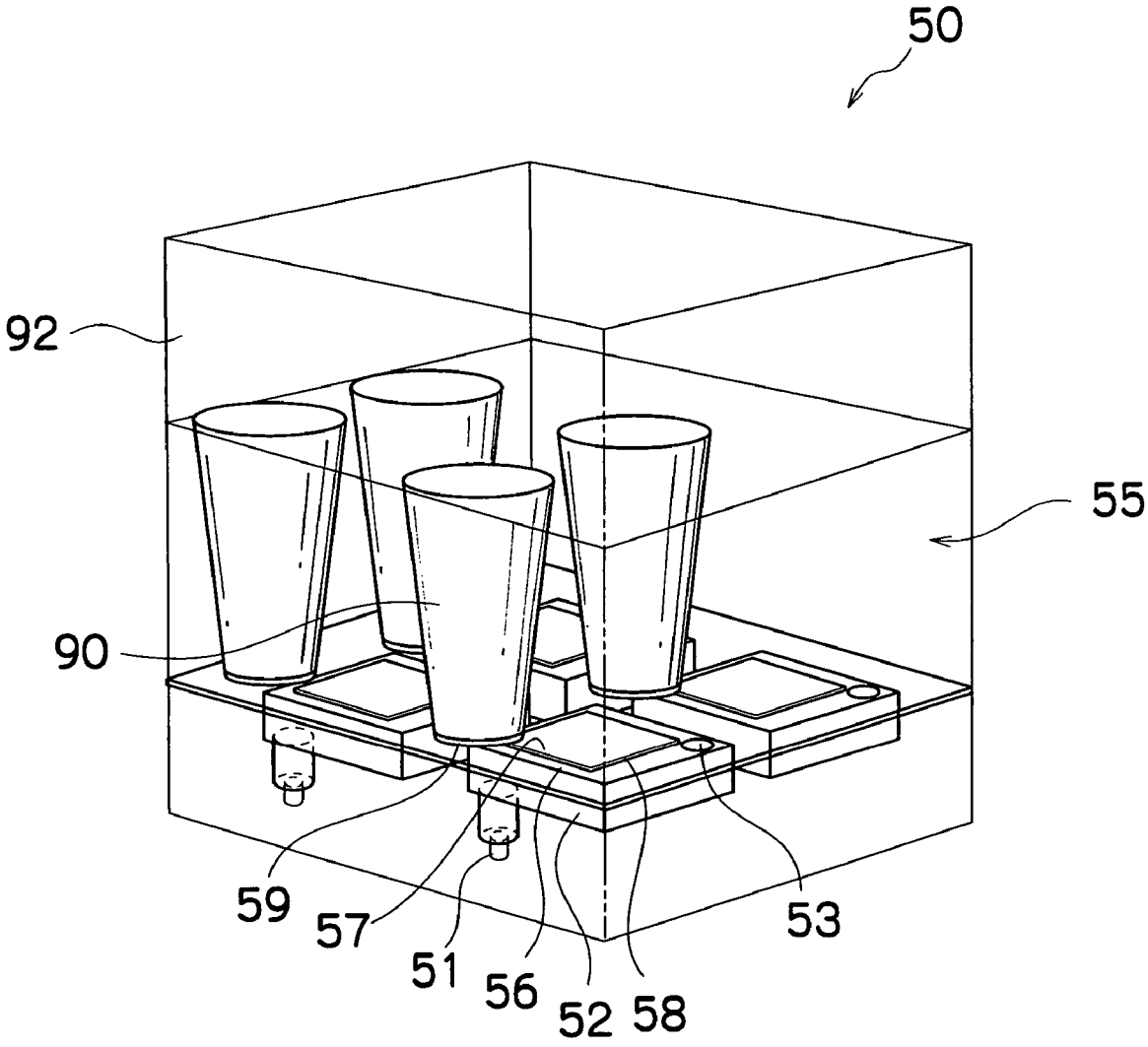
FIG. 7 is an oblique perspective diagram showing a partial enlarged view of the print head in the inkjet recording apparatus according to the embodiment.

FIG. 7 shows an oblique perspective view simplified a part of a print head 50 formed in high density, in this way.

As shown in FIG. 7, in the print head 50 according to the present embodiment, diaphragm 56 which form the upper surface of pressure chambers 52 are disposed on the upper side of pressure chambers 52 each having a nozzle 51 and an ink supply port 53, and piezoelectric elements 58 (piezoelectric actuators) as the pressure generating devices constituted by a piezoelectric body, such as a piezo element, which is sandwiched between upper and lower electrodes, are disposed in a position on the diaphragm 56 corresponding to the respective pressure chambers 52. An individual electrode 57 is provided on the upper surface of each piezoelectric element 58.

Electrode pads 59 as electrode connecting sections are extracted to the outer sides from the end faces of each individual electrode 57, and then electrical wires 90 are formed on those electrode pads 59 so as to rise up in a substantially perpendicular direction to a plane including the piezoelectric elements 58 (pressure generating devices). A multi-layer flexible cable 92 is provided above the electrical wires 90 which rise up in a substantially perpendicular direction to the plane including the piezoelectric elements 58, and therefore the drive signals are supplied from the head driver 84 to the individual electrodes 57 of the piezoelectric elements 58 via those wires.

Furthermore, the space in which the column-shaped electrical wires 90 are erected between the diaphragm 56 and the flexible cables 92 is formed into a common liquid chamber 55 for supplying ink to the respective pressure chambers 52 via the respective ink supply ports 53.

Incidentally, the common liquid chamber 55 shown in FIG. 7 is one large space formed throughout the whole region where the pressure chambers 52 are formed so as to supply ink to all of the pressure chambers 52 shown in FIG. 3. However, the common liquid chamber 55 is not limited to those formed in one space, and may be formed by dividing up the space into several regions.

Each of the electrical wires 90 rises up perpendicularly like a column on top of the electrode pads 59 provided connecting to the individual electrodes 57 at each pressure chamber 52, and supports the flexible cable 92 from below so as to create a space which forms the common liquid chamber 55. In this way, the electrical wires 90 which rise up like columns may also be called "electric columns", due to that shape. In other words, the electrical wires 90 (electrical columns) are formed so as to pass through the common liquid chamber 55.

Incidentally, the electrical wires 90 shown in FIG. 7 are formed independently with respect to each of the piezoelectric elements 58 (or the individual electrodes 57 thereof), in a one-to-one correspondence. However, in order to reduce the number of wires (the number of electrical columns), it is also possible to make one electrical wire 90 correspond to a plurality of piezoelectric elements 58, in such a manner that the wires corresponding to several piezoelectric elements 58 are gathered together and are formed into one electrical wire 90. Furthermore, the wiring to the common electrode (diaphragm 56) may also be formed as electrical wires 90, in addition to that connected to the individual electrodes 57.

Nozzles 51 are formed in the bottom surfaces as shown in FIG. 7, and ink supply ports 53 are provided on the upper surfaces in corner sections which are symmetrical with respect to the nozzles 51. The ink supply ports 53 are pierced through the diaphragm 56, and then the upper-positioned common liquid chamber 55 and the pressure chambers 52 are connected directly by means of the ink supply ports 53. Consequently, it is possible to form a direct fluid connection between the common liquid chamber 55 and each of the pressure chambers 52.

The diaphragm 56 is formed in a single plate which is common to all of the pressure chambers 52. Piezoelectric elements 58 deforming the pressure chambers 52 are disposed on the diaphragm 56 in positions corresponding to the respective pressure chambers 52. Electrodes (a common electrode and an individual electrode) for driving the piezoelectric elements 58 by applying a voltage thereto are formed on the upper and lower surfaces of respective piezoelectric elements 58, thereby sandwiching the piezoelectric elements 58.

The diaphragm 56 may be formed as a thin conductive film made of stainless steel, or the like, in such a manner that the diaphragm 56 may also serve as a common electrode. In this case, individual electrodes 57 driving the piezoelectric elements 58 independently are provided on the upper surface of each of the piezoelectric elements 58.

As described above, the electrode pads 59 are formed leading from the respective individual electrodes 57, and the electrical wires 90 (electrical columns) which pass through the common liquid chamber 55 are formed rising up perpendicularly from the electrode pads 59. The method of manufacturing the electrical wires 90 (electrical columns) is described hereinafter, but in this manufacturing process, the electrical wires 90 are formed in a tapered shape, as shown in FIG. 7.

A multi-layer flexible cable 92 is formed on top of the column-shaped electrical wires 90. The multi-layer flexible cable 92 is supported on the pillars formed by the electrical wires 90. Thereby, a space is formed as the common liquid chamber 55 by taking the diaphragm 56 as the base, and the multi-layer flexible cable 92 as the ceiling. Although not shown in the drawings, the respective individual electrodes 57 are each connected independently to the respective electrical wires 90, in such a manner that drive signals are supplied respectively to the individual electrodes 57, thereby driving the piezoelectric elements 58.

Furthermore, although not shown in FIG. 7, since the common liquid chamber 55 is filled with ink, the surface, which makes contact with the ink, of the diaphragm 56 as the common electrode, the individual electrodes 57, the electrical wires 90, and the multi-layer flexible cable 92 are covered respectively with an insulating protective film.

Incidentally, there is no particular restriction on the size of the print head 50 described above, but as one example, the pressure chambers 52 have an approximately square planner shape of 300 μm×300 μm (the corners thereof being curved in order to prevent stagnation points in the ink flow), and the height of the pressure chambers 52 is 150 μm. In addition, each of the diaphragm 56 and the piezoelectric elements 58 has a thickness of 10 μm, and the electrical wires 90 (electrical columns) have a diameter of 100 μm at the connection with the electrode pads 59, and a height of 500 μm.

Figure 8:
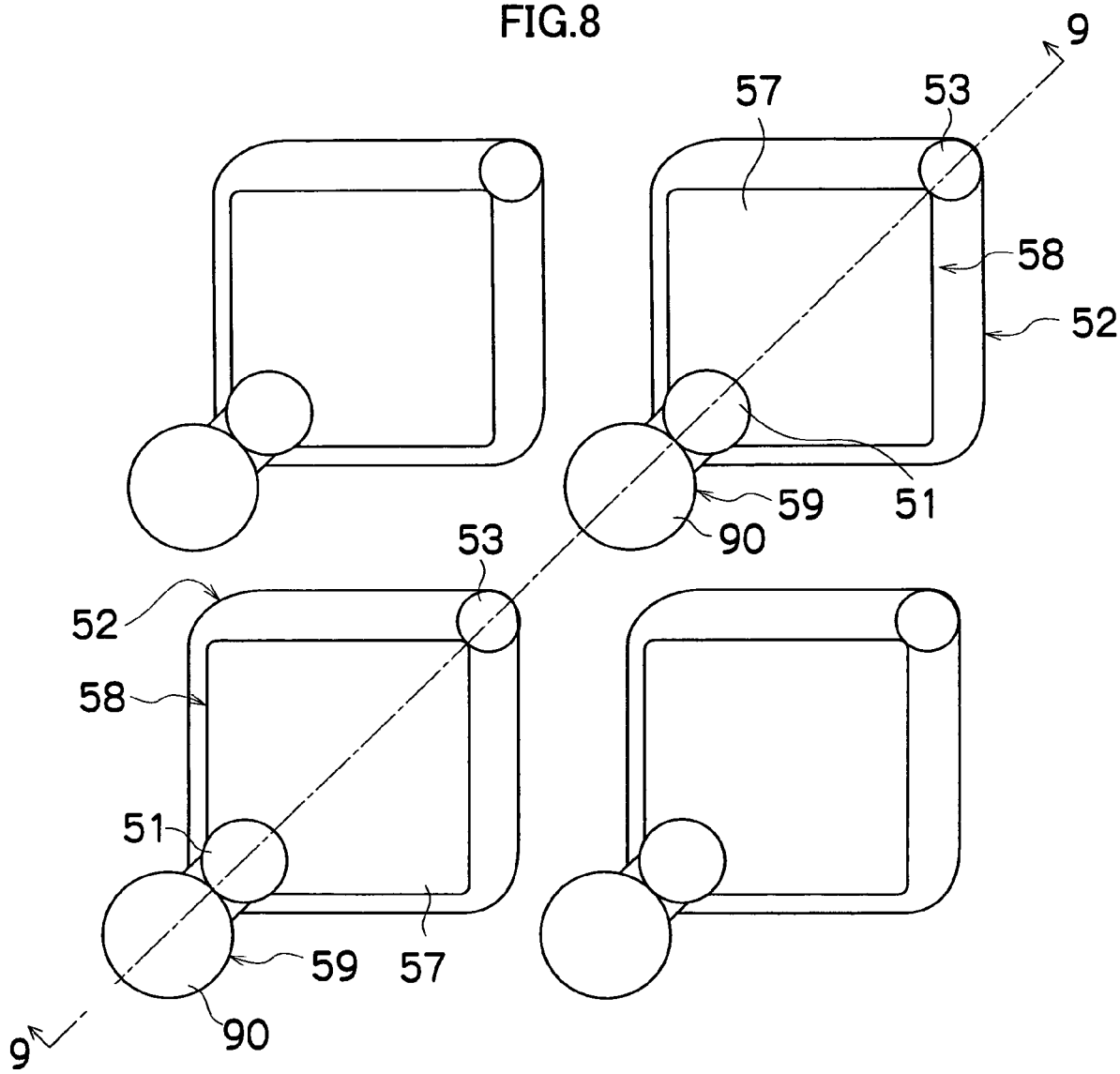
FIG. 8 is a plan view perspective diagram showing a partial enlarged view of a pressure chamber.

FIG. 8 shows a part of pressure chambers 52 of this kind, in an enlarged plan view perspective diagram. As described previously, each of the pressure chambers 52 has a substantially square shape, and the nozzle 51 and the ink supply port 53 are formed at respective corners of a diagonal of the respective pressure chamber 52. In addition, the electrode pads 59 are extracted adjacently to the nozzles 51, and the electrical wires (electrical column) 90 are formed on top of the electrode pads 59.

Figure 9:
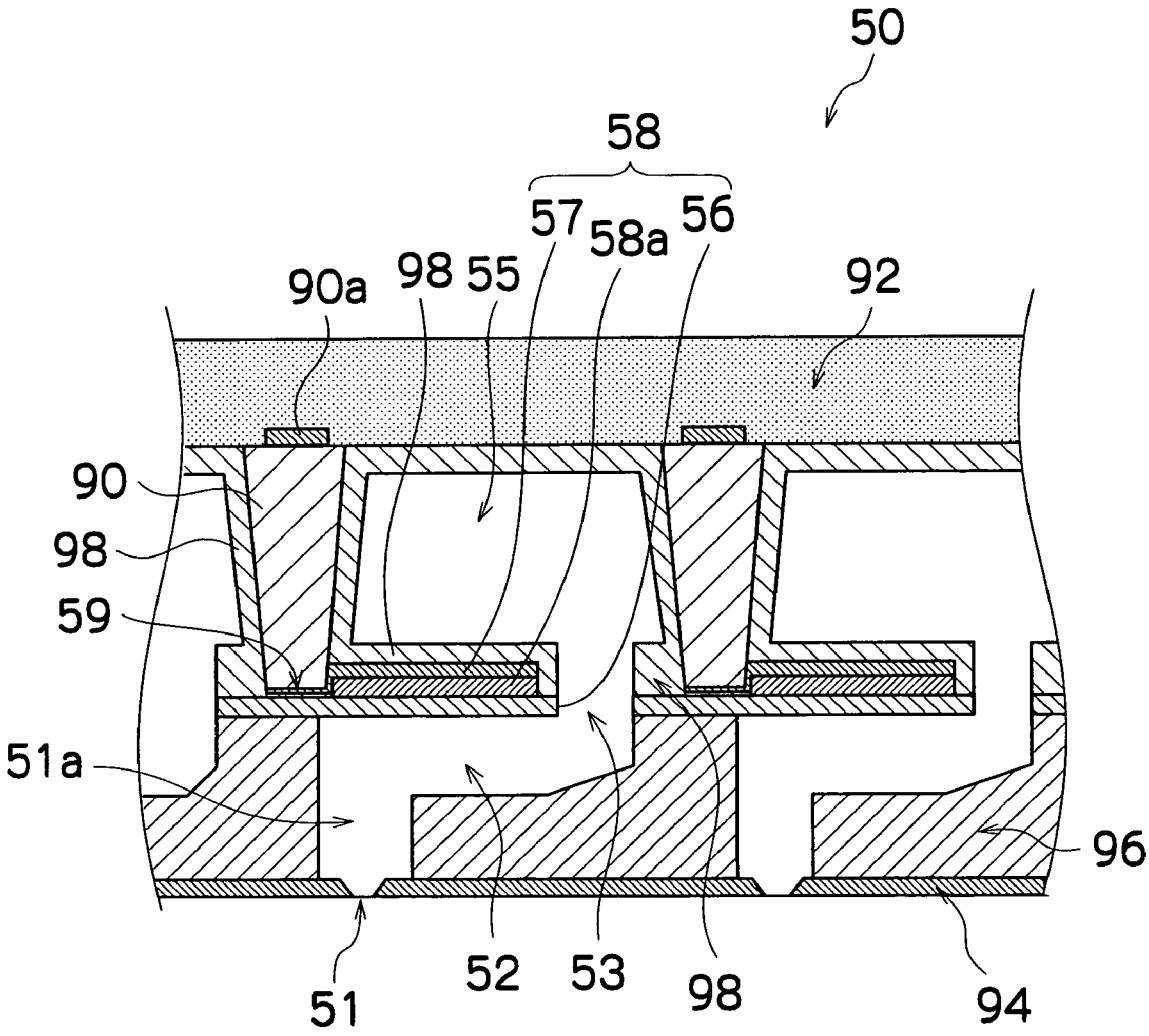
FIG. 9 is a cross-sectional diagram along line 9-9 in FIG. 8.

FIG. 9 is a cross-sectional diagram along line 9-9 in FIG. 8.

As shown in FIG. 9, the print head 50 according to a first embodiment is formed by laminating together a plurality of thin plates, or the like. First, a flow channel plate 96 formed with the pressure chambers 52, the ink supply ports 53, and nozzle flow channels 51*a* linking the pressure chambers 52 and the nozzles 51, is layered onto a nozzle plate 94 formed with nozzles 51. In the diagram, the flow channel plate 96 is depicted as a single plate, but in practice, the flow channel plate 96 may also be formed by laminating together a plurality of plates.

Next, the diaphragm 56 forming the ceiling faces of the pressure chambers 52 is laminated onto the flow channel plate 96. Desirably, the diaphragm 56 also serves as a common electrode for driving the piezoelectric elements 58, as described below in conjunction with the individual electrodes 57. Furthermore, opening sections corresponding to the ink supply ports 53 of the pressure chambers 52 are provided in the diaphragm 56, thereby providing direct connection between the pressure chambers 52 and the common liquid chamber 55 formed on the upper side of the diaphragm 56.

Next, a piezoelectric bodies 58*a* are formed on the diaphragm 56 (common electrodes) in regions corresponding to approximately the whole upper surfaces of the pressure chambers 52, and the individual electrodes 57 are formed on the upper surfaces of the piezoelectric bodies 58*a*. The piezoelectric bodies 58*a* sandwiched between a lower common electrode (diaphragm 56) and upper individual electrodes 57 in this way reduce the volume of the pressure chambers 52 by deforming when a voltage is applied via the common electrodes 56 and the individual electrodes 57, thereby constituting a piezoelectric elements 58 (piezoelectric actuators) which cause ink to be ejected from the nozzles 51.

Next, the electrode pads 59 as electrode connecting sections extracted to the outside are formed on the ends of the individual electrodes 57 adjacent to the nozzles 51. Thereupon, a column-shaped electrical wires 90 (electrical columns) are formed perpendicularly on tops of the electrode pads 59 so as to pass through the common liquid chamber 55.

Then, a multi-layer flexible cable 92 is formed on tops of the electrical wires 90, and wires (not shown) formed in the multi-layer flexible cable 92 are connected via the electrodes pads 59 to each the electrical wires 90, in such a manner that drive signals for driving the piezoelectric elements 58 can be supplied via the respective electrical wires 90.

In addition, the space in which the column-shaped electrical wires 90 (electrical column) are erected between the diaphragm 56 and the multi-layer flexible cable 92 forms a common liquid chamber 55 which accumulate ink supplying to the pressure chambers 52. Since this space is filled with ink, the surface portions which make contact with the ink of the diaphragm 56, the individual electrodes 57, the piezoelectric bodies 58*a*, the electrical wires 90, and the multi-layer flexible cable 92 are covered with an insulating/protective film 98.

In this way, in the present embodiment, the common liquid chamber 55 which is conventionally disposed on the same sides of pressure chambers 52 with respect to the diaphragm 56 is transferred to the upper side of the diaphragm 56, in other words, the common liquid chamber 55 is disposed on the opposite sides to the pressure chambers 52. Therefore, in contrast to the prior art, no piping or the like is necessary for supplying the ink from the common liquid chamber 55 to the pressure chambers 52. In addition, since the size of the common liquid chamber 55 can be increased, the ink can be supplied reliably. Therefore, it is possible to achieve high nozzle density while also enabling driving at high frequency even when the nozzles are arranged at high density.

Furthermore, since the wiring to the individual electrodes 57 of the respective piezoelectric elements 58 rises up perpendicularly from the electrode pads 59 of the individual electrodes 57, it is possible to increase the density of the wiring used to supply drive signals to the piezoelectric elements 58.

Moreover, since the common liquid chamber 55 is positioned on the upper side of the diaphragm 56 in such a manner that the common liquid chamber 55 and pressure chambers 52 are connected by means of the direct ink supply ports 53, it is possible to provide a direct fluid connection between the common liquid chamber 55 and the pressure chambers 52. Additionally, since the common liquid chamber 55 is positioned on the upper side of the diaphragm 56, it is possible to reduce the length of the nozzle flow channels 51*a* from the pressure chambers 52 to the nozzles 51, in comparison with the prior art. Therefore, even if the nozzles 51 are formed to a high density, it is possible to eject ink of high viscosity (for example, approximately 20 cp to 50 cp), while the print head 50 with a flow channel structure capable of swift refilling after ejection is achieved.

Next, a method of manufacturing a print head 50 of this kind will be described as following.

FIGS. 10A to 10D show steps for manufacturing the print head 50 described above.

Figure 10A:
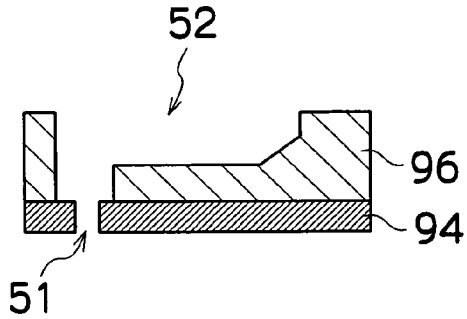
FIGS. 10A to 10D are illustrative diagrams showing steps for manufacturing a print head according to a first embodiment of the present invention.

Firstly, the pressure chambers 52 are formed as shown in FIG. 10A. The method of forming the pressure chambers 52 is not limited in particular, but as one example, stainless steel plates etched to create open spaces which are to form pressure chambers are laminated together, or alternatively, a silicon plate is etched to form a flow channel plate 96 having spaces for forming pressure chambers 52.

Next, a nozzle plate 94 having nozzle 51 (which is made of polyimide, for example) is bonded onto the flow channel plate 96 formed with a space which is to create the pressure chamber 52.

Figure 10B:
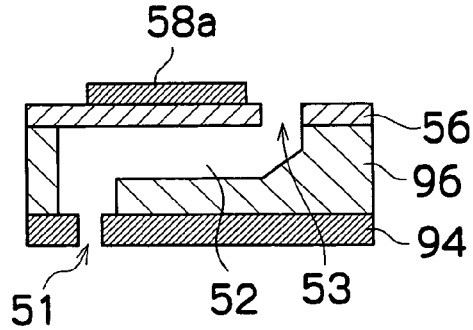

Next, as shown in FIG. 10B, a diaphragm 56 is bonded onto the flow channel plate 96 formed with the space which is to create the pressure chamber 52. Incidentally, the diaphragm 56 also serves as a common electrode. An aperture is provided in the diaphragm 56 in a position corresponding to the ink supply port 53 of the pressure chamber 52. Furthermore, a thin film-shaped piezoelectric body 58*a* is formed by AD (aerosol deposition) or sputtering on the upper side of the diaphragm 56, in a section corresponding to the respective pressure chamber 52. Alternatively, the piezoelectric body 58*a* may also be formed by grinding a bulk piezoelectric body. The diaphragm 56 and the piezoelectric body 58*a* are formed to a thickness of approximately 10 μm, for example.

Figure 10C:
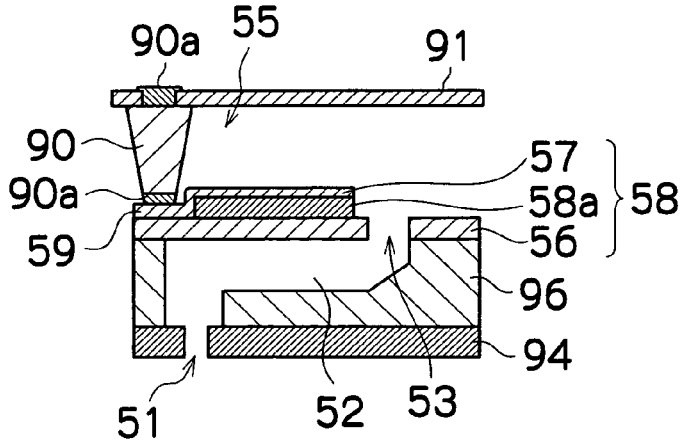

Next, a common liquid chamber 55 is formed as shown in FIG. 10C.

More specifically, after the individual electrode 57 is formed on the piezoelectric bodies 58*a* formed on the diaphragm 56, a part of the individual electrode 57 (for example, the end adjacent to the nozzle 51) is extracted to the outer side, thereby forming an electrode pad 59 for making a wiring connection.

Next, a wiring plate 91 on which electrical wire 90 (electrical column) is erected in a substantially perpendicular direction to this plate, is bonded in such a manner that the ends of the electrical wires 90 are connected to the electrode pads 59. Consequently, a common liquid chamber 55 is formed by taking the electrical wire 90 (electrical column) as a pillar, the diaphragm 56 as a floor, and the wiring plate 91 as a ceiling.

In this case, the front end of the electrical wire 90 is connected to the electrode pad 59 by means of a solder 90*a* provided on the end of the electrical wire 90. The method of fabricating the electrical wire 90 (electrical column) is described below.

The piezoelectric element 58 is constituted by piezoelectric body 58*a* which is sandwiched between a diaphragm 56 (common electrode) and an individual electrode 57 on the pressure chamber 52, and the common liquid chamber 55 is formed by bonding the wiring plate 91 formed with the electrical wire 90 (electrical column) onto a plate which is formed with the piezoelectric element 58. Then, although this is not shown in the diagram, an insulating/protective film is formed onto the sections which make contact with the ink in the common liquid chamber 55.

Figure 10D:
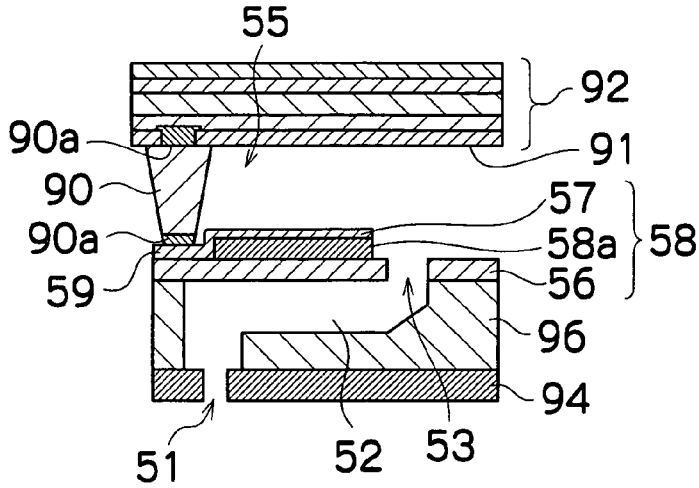

Finally, as shown in FIG. 10D, a multi-layer flexible cable 92 is bonded on top of the wiring plate 91, thereby forming the print head 50. The electrical wire 90 and the multi-layer flexible cable 92 are connected together by means of the solder 90*a* provided on the other end of the electrical wire 90. Furthermore, the multi-layer flexible cable 92 is formed in at least four layers or more.

Next, the method of manufacturing the electrical wires 90 (electrical columns) will be described as following.

FIGS. 11A to 11E show the steps for manufacturing the electrical wires 90.

Figure 11A:
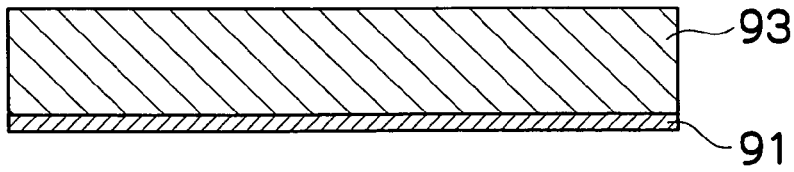
FIGS. 11A to 11E are illustrative diagrams showing steps for manufacturing electrical wires (electrical columns)
Figure 11B:
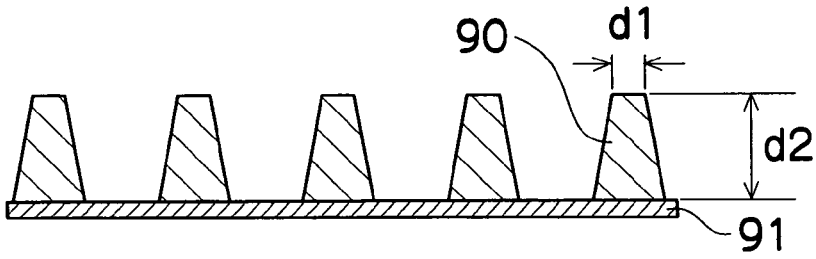

Firstly, as shown in FIG. 11A, a copper layer 93 having a thickness of approximately 500 μm is formed onto an insulating substrate as a wiring plate 91 for forming the electrical wires 90 (electrical columns). Next, as shown in FIG. 11B, the copper layer 93 having a thickness of approximately 500 μm is cut by etching in order to form column-shaped electrical wire 90 (electrical columns).

In this case, the electrical wires 90 (electrical columns) are formed so as to have a diameter d1 at the front end section (namely, the section which is subsequently to be connected to an electrode pad 59) of approximately 100 μm, and a height d2 of approximately 500 μm, which is equal to the thickness of the copper layer 93.

Figure 11C:
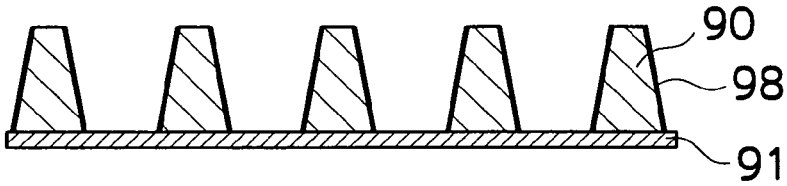

Next, as shown in FIG. 11C, an insulating/protective film 98 is coated onto the side faces of the column shapes of the electrical wires 90. As described previously, since the electrical wires 90 pass through the common liquid chamber 55, it is possible to prevent the electrical wires 90 from making contact with the ink at all times by the insulating/protective film 98.

Figure 11D:
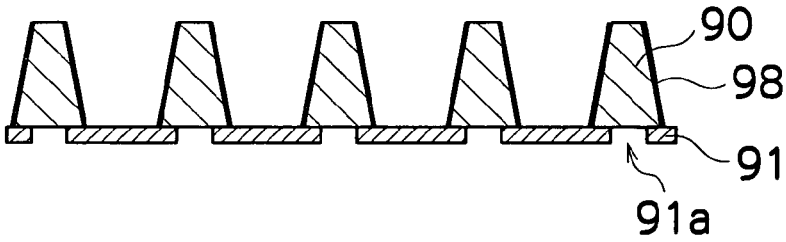

Next, as shown in FIG. 11D, the wiring plate 91 is processed from the under side, and holes 91*a* for connecting with the multi-layer flexible cable 92 are opened in the sections where the electrical wires 90 are located. The holes 91*a* may be formed previously in the wiring plate 91 before forming a copper layer 93 on the wiring plate 91.

Figure 11E:
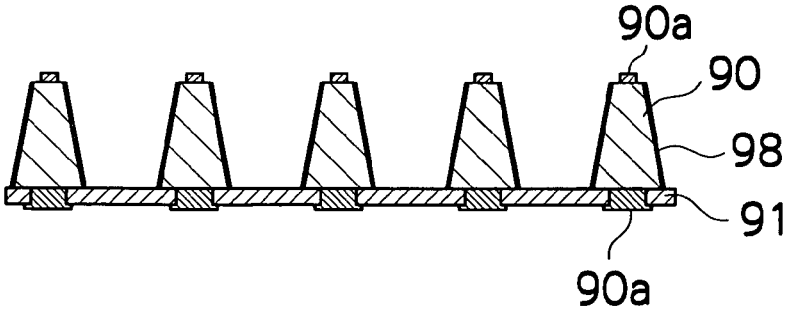

Finally, as shown in FIG. 11E, each of the electrical wires 90 is formed on the wiring plate 91 by introducing the solder 90*a* to the upper and lower end section of the respective electrical wire 90. The resulting structure is inverted vertically and is bonded to the flow channel plate 96 formed with pressure chambers 52 and the like, thereby forming the print head 50 as shown in FIGS. 10A to 10D.

Incidentally, instead of inverting the wiring plate 91 formed with the electrical wires 90 and then bonding same with the flow channel plate 96, the electrical wires 90 may be separated individually from the wiring plate 91 so as to bond the separated electrical wires 90 to the electrode pads 59 of the individual flow channel plates 96. Although installing the electrical wires 90 individually requires significant labor, it is not necessary to set accurately the position at which the electrical wires 90 are formed on the wiring plate 91.

Next, a second embodiment of the present invention will be described as following.

Figure 12:
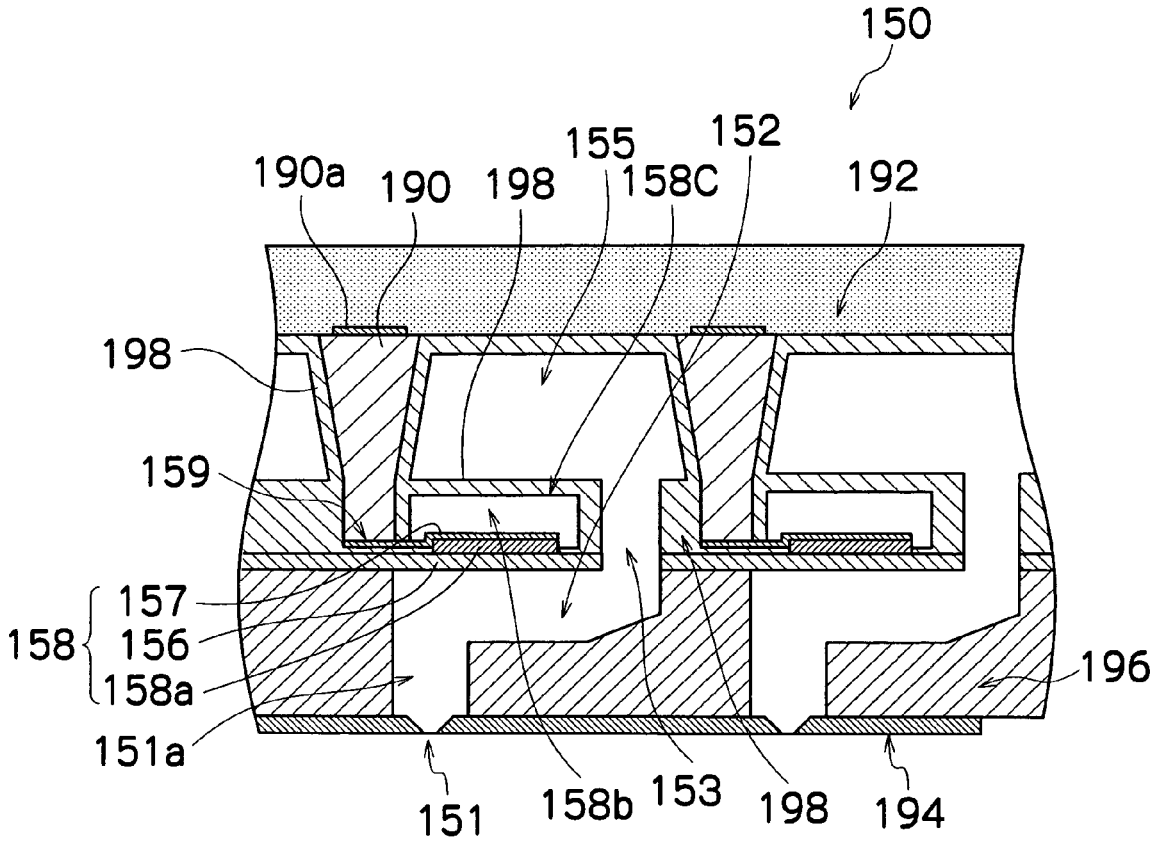
FIG. 12 is a cross-sectional diagram showing a print head according to a second embodiment of the present invention.

FIG. 12 shows a cross-sectional diagram of a print head according to the second embodiment of the present invention. FIG. 12 is a cross-sectional diagram similar to FIG. 9. In a print head 150 according to the present embodiment, a common liquid chamber 155 is formed at the opposite side to the pressure chamber 152 with respect to the diaphragm 156.

More specifically, as shown in FIG. 12, in the print head 150 according to the present embodiment, a flow channel plate 196 which forms with the pressure chambers 152 and the like, is disposed on a nozzle plate 194 including the nozzles 151, and the diaphragm 156 is placed on the flow channel plate 196.

The piezoelectric elements 158 are formed on the diaphragm 156, and comprise the diaphragm 156 as a common electrode, the piezoelectric bodies 158*a*, and the individual electrodes 157. The electrical wires 190 (electrical columns) are formed in a substantially perpendicular upward direction to the electrode pads 159 extracted from the individual electrodes 157.

A multi-layer flexible cable 192 is formed on the electrical wires 190, and the space between the diaphragm 156 and the multi-layer flexible cable 192 forms common liquid chambers 155. The electrical wires 190 are formed so as to pass through the common liquid chambers 155.

In this way, the print head 150 according to the present embodiment has an approximately similar composition to the print head 50 according to the first embodiment described above. As distinct from the print head 50 according to the first embodiment, in the print head 150 according to the present embodiment, gaps 158*b* for the operation of actuators (piezoelectric elements 158) are provided on top of the piezoelectric elements 158 constituted by the diaphragm 156 (common electrode), the piezoelectric bodies 158*a*, and the individual electrodes 157.

The gaps 158*b* are formed by respectively providing frames 158*c* around the piezoelectric elements 158 so as to completely cover the piezoelectric bodies 158*a* and the individual electrodes 157. In addition, an insulating/protective film 198 is formed on the surface of the frames 158*c*. In this case, the frames 158*c* may be formed by means of the insulating/protective film 198 only.

In this way, since the gaps 158*b* are provided above the piezoelectric elements 158, it is possible to decrease the resistance exerted by driving the piezoelectric elements 158. Therefore, since the piezoelectric elements 158 can be operated more readily, it is possible to improve the driving efficiency of the piezoelectric elements 158.

The remaining sections according to the present embodiment are exactly the same as the first embodiment described above, and hence the last two digits of the reference numerals are the same as those of the first embodiment, and detailed description is omitted here.

Next, a third embodiment of the present invention will be described as following.

Figure 13:
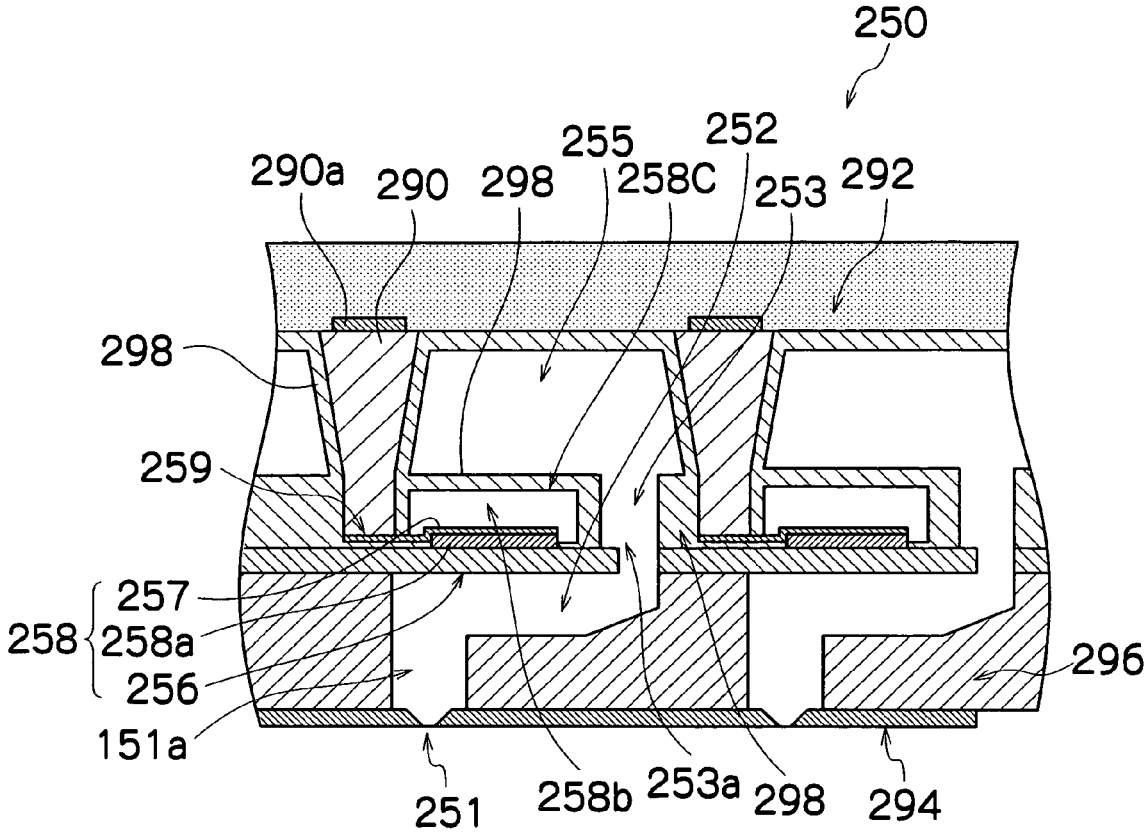
FIG. 13 is a cross-sectional diagram showing a print head according to a third embodiment of the present invention.

FIG. 13 shows a cross-sectional diagram of a print head according to the third embodiment of the present invention, as similar to FIG. 12.

As shown in FIG. 13, the print head 250 according to the present embodiment has an approximately similar composition to the print head 150 according to the second embodiment shown in FIG. 12.

In other words, as similarly to the print head 150 of the second embodiment, in the print head 250 according to the present embodiment, the common liquid chambers 255 are positioned on the upper side of the diaphragm 256, and the electrical wires 290 are erected perpendicularly so as to pass through the common liquid chambers 255. In addition, the gaps 258*b* are provided in order to facilitate the operation of the piezoelectric bodies 258.

As distinct from the print head 150 of the second embodiment, in the print head 250 according to the present embodiment, ink reflux preventing restrictors 253*a* having a narrow diameter are provided in portions of the ink supply ports 253 which supplies ink from the common liquid chambers 255 to the pressure chambers 252.

Incidentally, there is no particular restriction on the method of forming the restrictor 253*a*, but in the print head 250 shown in FIG. 13, the restrictors 253*a* are formed by reducing the diameter of apertures which are formed at the side of the ink supply ports 253 in the diaphragm 256.

In cases in which these restrictors 253*a* are not provided as described in the aforementioned first and second embodiments, it is possible to shorten the refill time after ejection of high-viscosity ink, in particular, as shown previously. On the other hand, in the case in which the restrictors 253*a* are provided as described in the third embodiment, since it is possible to improve the ejection efficiency when using low-viscosity ink, the power consumption of the piezoelectric elements can be lowered and the size of the pressure chambers can be reduced.

Hereinafter, the beneficial effects achieved by providing the restrictors 253*a* according to the third embodiment are described.

Figure 14:
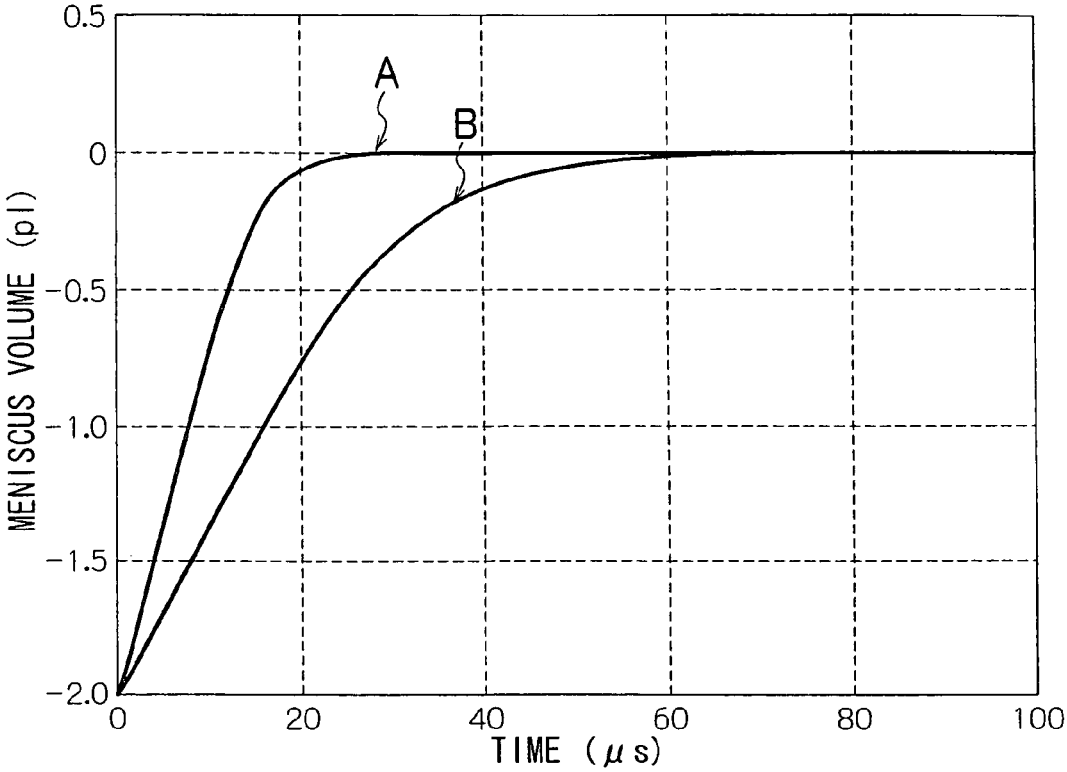
FIG. 14 is a graph showing a comparison of refill characteristics in cases in which a restrictor is present or not in relation to an ink having a viscosity of 20 cP.

FIG. 14 is a graph showing refilling characteristics in cases in which the restrictor 253*a* is present or not, when ejecting 2 pl of the ink having a viscosity of 20 cP. Incidentally, the specific method of analyzing the refill characteristics is described below.

In FIG. 14, the graph A shows a characteristic curve when the restrictor 253*a* is not present, and the graph B shows a characteristic curve when the restrictor 253*a* is present. Furthermore, in FIG. 14, the horizontal axis indicates the time (μsec), and the vertical axis indicates a meniscus volume (pl). Herein, when the meniscus volume has become zero, the refill is completed. On the other hand, when the meniscus volume is positive (>0), the meniscus surface is stocked out the initial position thereof.

As shown by the graph B in FIG. 14, if the restrictor 253*a* is present, then the refill time is 60 μsec. On the other hand, as shown by the graph A, if the restrictor 253*a* is not present, the refill time becomes 30 μsec, which is half the time achieved when the restrictor 253*a* is present.

Figure 15:
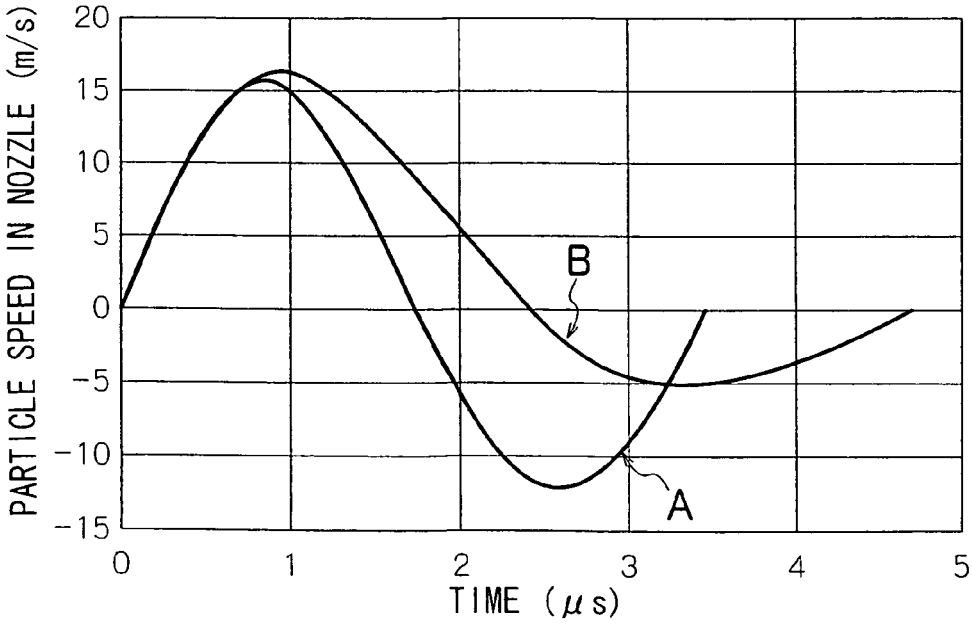
FIG. 15 is a graph showing a comparison of ejection characteristics in cases in which a restrictor is present or not in relation to an ink having a viscosity of 20 cP.

FIG. 15 is a graph showing ejection characteristics in cases in which the restrictor 253*a* is present or not, when ejecting 2 pl of the ink having a viscosity of 20 cP. Incidentally, the specific method of analyzing the ejection characteristics is described hereinafter.

In FIG. 15, the graph A shows a characteristic curve when the restrictor 253*a* is not present, and the graph B shows a characteristic curve when the restrictor 253*a* is present. Furthermore, in FIG. 15, the horizontal axis indicates the time (μsec), and the vertical axis indicates the particle speed in nozzle (m/sec). In FIG. 15, the important parameters relating to the ejection characteristics are the ejection droplet speed and the ejection droplet volume. The speed is proportional to the particle speed in nozzle, and the volume is proportional to the surface area enclosed by the graph curves and the line of vertical axis value=0. Consequently, as evidenced by FIG. 15, the graph A and the graph B indicate approximately the same characteristics. In other words, when ejecting the ink having a viscosity of 20 cP, there is little change relating to the ejection characteristics depending on whether or not the restrictor 253*a* is present.

This ejection characteristic can be explained as following. During ejection, the ink flow toward the nozzle side is a flow in the ejecting direction, and the ink flow toward the supply side is a flow in the reflux direction. In this case, a ratio between the ink volumes moving toward the nozzle side and the supply side, namely (nozzle side)/(supply side+nozzle side) is equal to 0.54 when the restrictor 253*a* is present, and the (nozzle side)/(supply side+nozzle side) is equal to 0.28 when the restrictor 253*a* is not present. Therefore, efficiency is twice as good when the restrictor 253*a* is present, compared to when the restrictor 253*a* is present. Furthermore, while the attenuation rate is 1.32 when the restrictor 253*a* is present, the attenuation rate is 1.79 when the restrictor 253*a* is not present. This means that the attenuation rate is 1.4 greater when the restrictor 253*a* is present. Consequently, since these two effects can be thought to cancel each other out, it is considered that there is no great difference between the ejection characteristics when the restrictor 253*a* is present or not.

From the above, in the case of using the high-viscosity ink having a viscosity of 20 cP, it is possible to shorten the refilling time without significantly affecting the ejection characteristics, even if the restrictor is not present. Therefore, it is possible to perform the high-frequency ejection.

Figure 16:
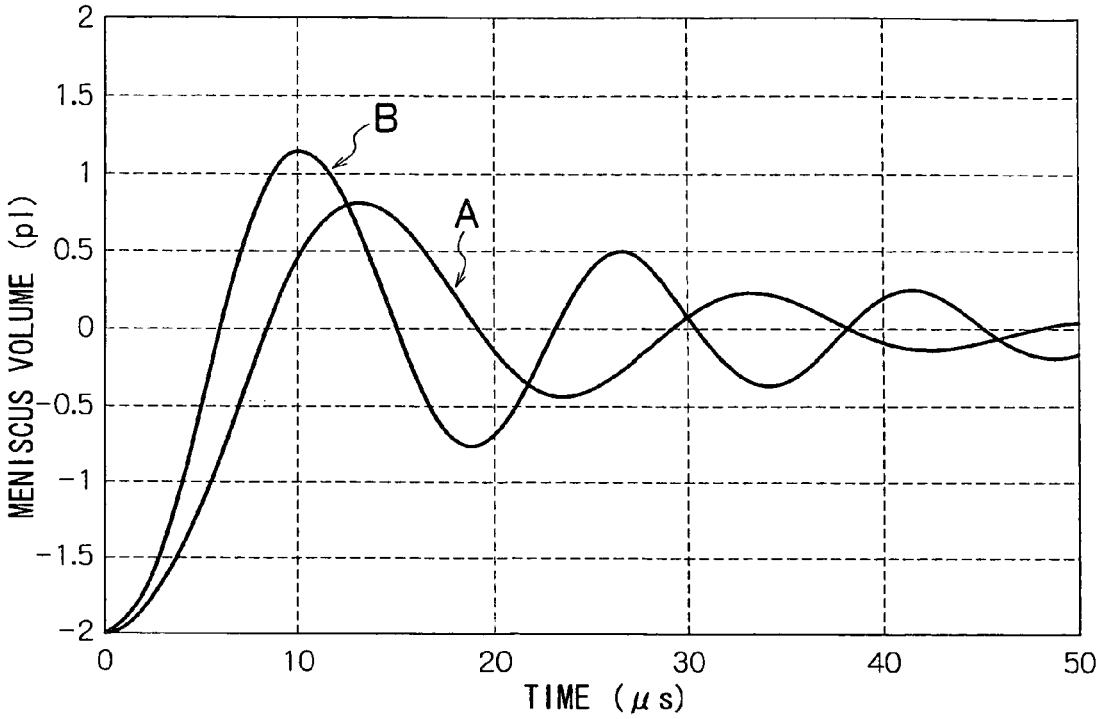
FIG. 16 is a graph showing a comparison of refill characteristics in cases in which a restrictor is present or not in relation to ink having a viscosity of 2 cP.
Figure 17:
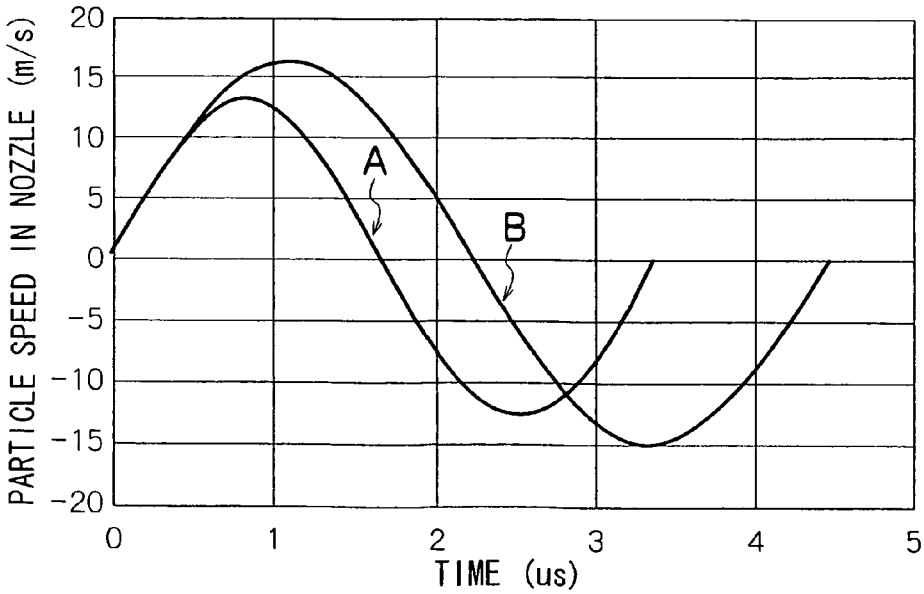
FIG. 17 is a graph showing a comparison of ejection characteristics in cases in which a restrictor is present or not in relation to ink having a viscosity of 2 cP.

Similarly, FIG. 16 a graph showing refill characteristics in cases in which the restrictor 253*a* is present or not, when ejecting 2 pl of ink having a viscosity of 2 cP. FIG. 17 a graph showing the ejection characteristics in the same conditions.

In this case, as shown in FIG. 16, the meniscus surface vibrates greatly, regardless of whether or not the restrictor 253*a* is present. Therefore, in order to shorten the refill time, it is essential to suppress the vibration of the meniscus surface, irrespective of the presence or absence of the restrictor 253*a*.

On the other hand, as shown in FIG. 17, there is a change relating to the ejection characteristic at a viscosity of 2 cP, depending on whether or not the restrictor is present. As reasons for this changing, although the presence or absence of a restrictor has virtually no effect on the attenuation rate, the ratio of the ink volumes moving toward the nozzle side and the supply side, namely (nozzle side)/(supply side+nozzle side) is equal to 0.53 when the restrictor 253*a* is present, and (nozzle side)/(supply side+nozzle side) is equal to 0.31 when the restrictor 253*a* is not present. Therefore, the efficiency is 1.7 times better when a restrictor is present.

From the above, in the case of a low-viscosity ink such as 2 cP, when the restrictor 253*a* is present, it is possible to cause the restrictor 253*a* to improve the ejection efficiency, rather than the restrictor 253*a* being a factor which governs the refill time.

Next, specific methods for analyzing the refill characteristics and the ejection characteristics, which only the results is described above, will be described as following.

Figure 18:
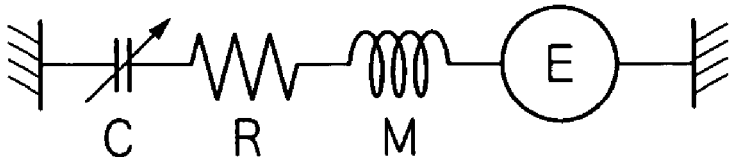
FIG. 18 is a circuit diagram showing an equivalent circuit model used for analyzing refill characteristics.

An equivalent circuit model such as that shown in FIG. 18 is used to analyze the refill characteristics. In FIG. 18, "R" is the combined resistance of the nozzle and the supply restrictor; "M" is the combined inertance of the nozzle and supply restrictor; and "C" is the compliance of the nozzle meniscus, which is a value varying according to the shape of the meniscus (the refill state). Taking the distance from the upper surface of the nozzle to the lowest part of the meniscus to be "y"; the radius of the nozzle to be "$r_n$"; and the surface tension of the ink to be "σ", the compliance C is shown as a following equation (1):

$$C = \frac{1}{2} \cdot \frac{\pi \cdot r_n^4 \cdot \sqrt{1 + \left(\frac{2 \cdot y}{r_n}\right)^2}}{4 \cdot \sigma} \quad (1)$$

Figure 19:
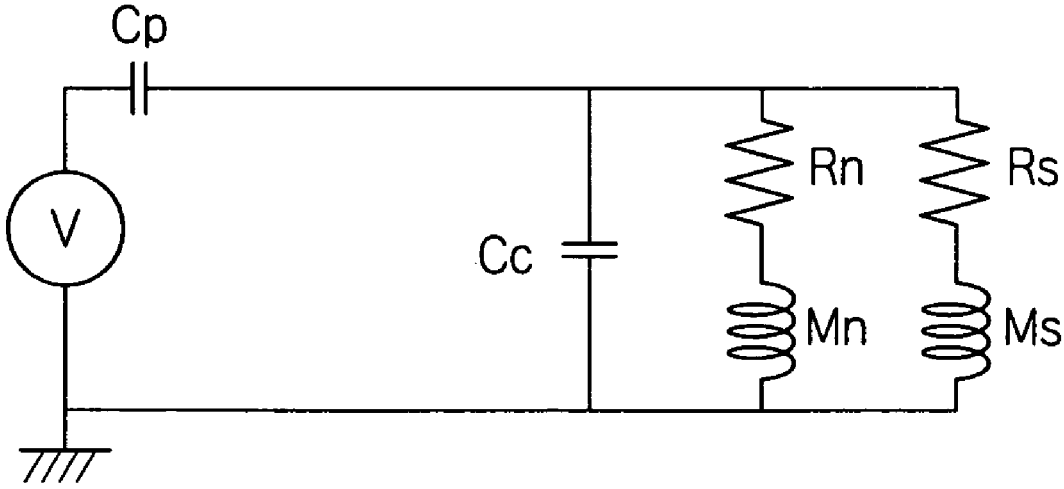
FIG. 19 is a circuit diagram showing an equivalent circuit model used for analyzing ejection characteristics.

Furthermore, an equivalent circuit model shown in FIG. 19 is used for analyzing the ejection characteristics. In FIG. 19, "$C_p$" is the compliance of the piezo actuator, "$C_c$" is the compliance of the pressure chamber, "$R_n$" is the nozzle resistance, "$R_s$" is the supply restrictor resistance, "$M_n$" is the nozzle inertance, "$M_s$" is the supply restrictor inertance, and "V" is the pressure generated by the piezo actuator.

FIG. 20 shows actual values of the respective elements used for analyzing the refill characteristics and the ejection characteristics. In FIG. 20, the term "nozzle side" includes the nozzle and a connection path from the pressure chamber to the nozzle, and the term "supply side" includes the supply restrictor and a connection path to the common liquid chamber.

As described above, according to the first and second embodiments shown in FIGS. 9 and 12, the ink supply port 53 or 153 which connects the common liquid chamber 55 or 155 with the pressure chamber 52 or 152, has a uniform diameter, and no particular restrictor is provided therein. In this case, the reflux is suppressed by the mass of the actual ink in a section of the ink supply port 53 or 153 between the common liquid chamber 55 or 155 and the pressure chamber 52 or 152.

This case gives high priority to reliably supplying the ink when driving ejection at high frequency or when using ink of high viscosity. On the other hand, in the third embodiment, the restrictor 253*a* having a narrow diameter is provided in order to prevent a reflux more effectively.

Incidentally, the remaining composition except for the restrictor 253*a* is the same as the composition in the first and second embodiments described above, and hence the same last two digits are used for the reference numerals of the respective constituent elements, and detailed description thereof is omitted here.

Next, a fourth embodiment of the present invention will be described as following.

In the fourth embodiment, in contrast to the compositions described above, a common liquid chamber is disposed on the same side of a diaphragm as a pressure chamber, similarly to the prior art. However, in the fourth embodiment, electrical wires for supplying drive signals to the individual electrodes of the piezoelectric elements pass are also formed perpendicularly with respect to the nozzle surface so as to pass through the common liquid chamber.

Figure 21:
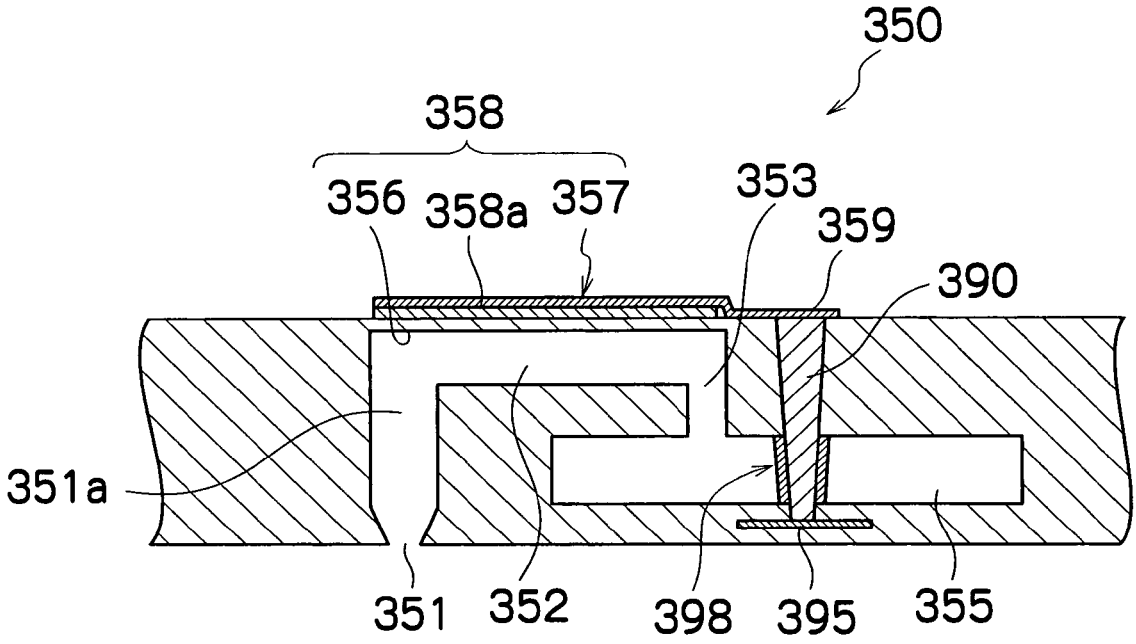
FIG. 21 is a cross-sectional diagram showing a print head according to a fourth embodiment of the present invention.

FIG. 21 shows a cross-sectional diagram of a print head according to the fourth embodiment of the present invention.

FIG. 21 is a cross-sectional diagram showing a portion corresponding to one pressure chamber unit 54 shown in FIG. 3, which is cut along a perpendicular face to the nozzle surface while passing through the nozzle, the ink supply port and the electrical wire (electrical column), for example.

As shown in FIG. 21, in the print head 350 according to the present embodiment, the ceiling of a pressure chamber 352 is formed by a diaphragm 356 which also serves as a common electrode. Apiezoelectric body 358*a* is bonded onto the diaphragm 356, and an individual electrode 357 is formed on the upper surface thereof. A piezoelectric body 358 is constituted by the common electrode (diaphragm 356), a piezoelectric body 358*a*, and an individual electrode 357. The pressure chamber 352 is connected to a nozzle 351 through a nozzle flow channel 351*a*, and is also connected via an ink supply port 353 to a common liquid chamber 355 which is provided on the same side of the diaphragm 356 as a pressure chamber 352 (the under side of the pressure chamber 352 in the diagram).

Furthermore, as shown in FIG. 21, an electrode pad 359 as an electrode connection section is extracted from the individual electrode 357, and an electric wire 390 (electrical column) is formed in a substantially perpendicular direction to the nozzle surface, downward from the electrode pad 359. The electric wire 390 passes through the plate forming the pressure chamber 352, extends downward through the common liquid chamber 355 toward the nozzle plate having the nozzle 351, and connects to a wiring section 395 which provided below the common liquid chamber 355. A part of the electric wire 390 passing through the common liquid chamber 355, which makes contact with the ink, is protected by an insulating/protective film 398.

The wiring section 395 extends inside the print head 350 along the nozzle surface until the end of the head, and is connected to a flexible cable (not shown) so as to receive a supply of drive signals.

All of the electrical wires according to the present embodiment are not formed so as to pass through the common liquid chamber 355 in this way. Similarly to the prior art, there are also either electrical wires formed from the individual electrodes 357 on top of the diaphragm 356, or electrical wires connected to a flexible cable.

By alternately forming a structure in which electrical wires 390 (electrical columns) passing through the common liquid chamber 355 are formed so as to pass through the base of the common liquid chamber 355, and a conventional structure in which wires are formed above the diaphragm 356, it is possible to ensure sufficient wiring space for the electrodes. Therefore, it is possible to form the wiring to a higher density. In addition, it is also possible to achieve even higher density of the nozzles by increasing the density of the wiring.

Next, a fifth embodiment of the present invention will be described as following.

In the first to fourth embodiments described above, the piezoelectric elements (58, etc.) have been used as pressure generating devices. However, the fifth embodiment is different from other embodiments described above, and an electrostatic actuator as the pressure generating devices are used for driving and controlling the diaphragm (56, etc) by means of an electrostatic action.

The electrostatic actuator attracts and bends a diaphragm by means of a negative charge or a positive charge on the surface of the diaphragm corresponding to a positive charge or negative charge on the electrode surface when a pulse voltage is applied. On the other hand, when the electrode is switched off, the volume of the pressure chamber is decreased by means of a returning action of the diaphragm surface, and then the ink is ejected from the nozzle by raising instantaneously the pressure inside the pressure chamber.

Figure 22:
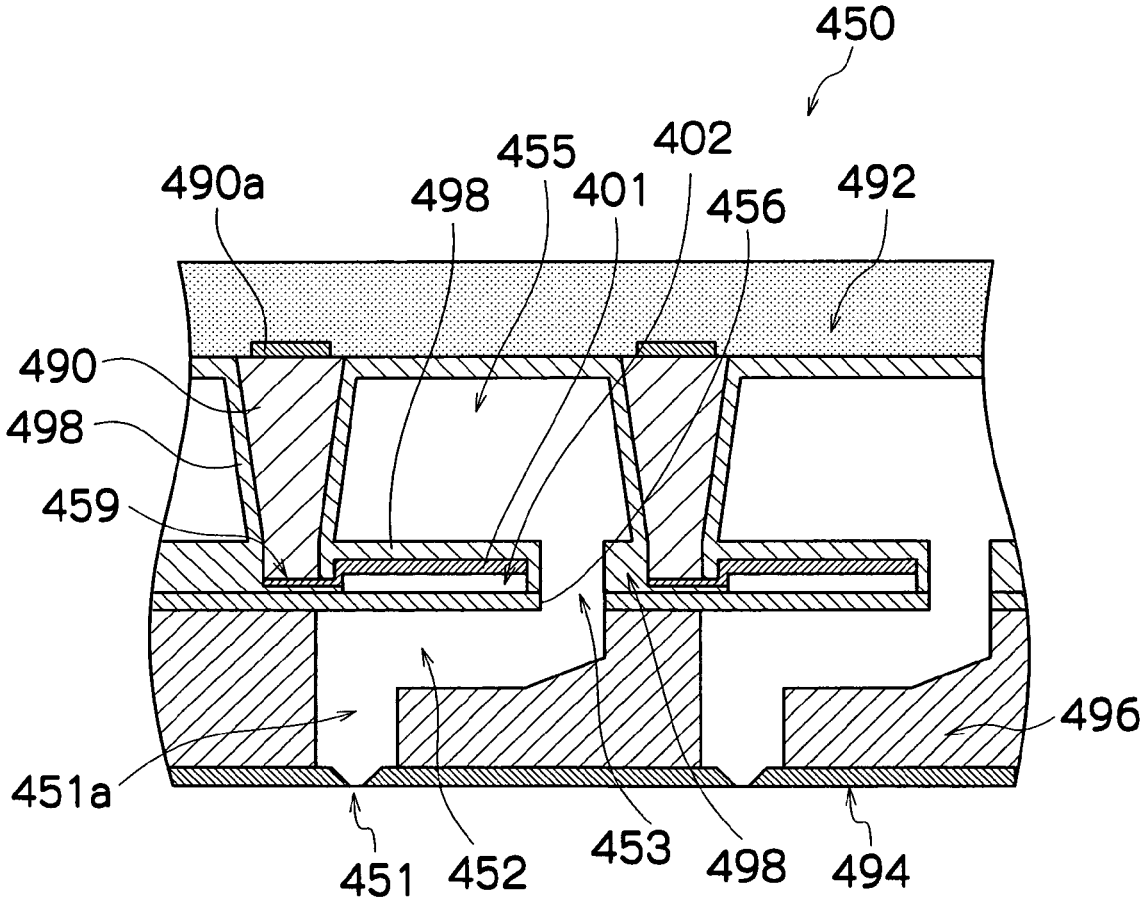
FIG. 22 is a cross-sectional diagram showing a print head according to a fifth embodiment of the present invention.

FIG. 22 is a cross-sectional diagram showing a print head according to the fifth embodiment.

FIG. 22 is a cross-sectional diagram similar to FIG. 9, for example. As shown in FIG. 22, the print head 450 according to the fifth embodiment is similar to the print head 50 shown in FIG. 9 according to the first embodiment described above, expect for the pressure generating devices. More specifically, in the print head 450, a common liquid chamber 455 is positioned on the upper side of the diaphragm 456, and an electrical wire 490 is erected perpendicularly so as to pass through the common liquid chamber 455.

Furthermore, as the pressure generating device according to the present embodiment, an electrostatic actuator type electrode 401 is disposed on the diaphragm 456, and is coated with an insulation/protective film 498. A gap 402 is provided between the electrode 401 and the diaphragm 456.

Moreover, an electrode pad 459 is extracted from the electrode 401, and an electric wire 490 which rises up perpendicularly is connected onto the electrode pad 459. The upper side of the electrode wire 490 is connected to a multi-layer flexible cable 492 through another electrode pad 490*a*. A pulse voltage is applied to the electrode 401 via the electrical wire 490.

Incidentally, a remaining composition according to the fifth embodiment is the same as the composition according to the first embodiment described above, and the same last two digits are used in the reference numerals and detailed description thereof is omitted here.

Hereinafter, the action of the present embodiment will be described.

When a prescribed pulse voltage is applied to the electrode 401 via the electrical wire 490, the surface of the electrode 401 is charged to a positive potential. In this time, the under face of the diaphragm 456 corresponding to the charged electrode 401 is charged to a negative potential. Consequently, the diaphragm 456 bends upward to the diagram due to the electrostatic force of attraction. When the diaphragm 456 is bended upward, the volume of the pressure chamber 452 is increased, and then ink is filled into the pressure chamber 452 from the common liquid chamber 455 via an ink supply port 453.

On the other hand, when the electrode 401 is switched off, the diaphragm 456 returns, thereby decreasing the volume of the pressure chamber 452. Consequently, the pressure inside the pressure chamber 452 increases suddenly, and then the ink is ejected from the nozzle 451.

As described above, the pressure generating devices according to the present invention are not limited to the piezoelectric elements, and it is also possible to use the electrostatic actuators as the pressure generating devices.

The liquid ejection head and the image forming apparatus comprising same according to the present invention have been described in detail above, but the present invention is not limited to the aforementioned examples, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a nozzle plate which has a plurality of ejection apertures through which a liquid is ejected;

a plurality of pressure chambers which are connected respectively to the ejection apertures;

a plurality of liquid supply flow channels which supply the liquid respectively to the pressure chambers;

a common liquid chamber which supplies the liquid to the liquid supply flow channels;

a plurality of pressure generating devices which respectively deform the pressure chambers; and a plurality of electrical wires which supply drive signals to the pressure chamber generating devices, wherein the electrical wires are provided so as to pass through the common liquid chamber.

2. The liquid ejection head as defined in claim 1, wherein the pressure generating devices are piezoelectric elements.

3. The liquid ejection head as defined in claim 1, wherein:

the pressure generating devices are disposed on an opposite side to the ejection apertures with respect to the pressure chambers; and the common liquid chamber is disposed on an opposite side to the pressure chambers with respect to the pressure generating devices.

4. The liquid ejection head as defined in claim 3, wherein the liquid supply flow channels are formed substantially perpendicular to a surface of the pressure generating devices.

5. The liquid ejection head as defined in claim 1, wherein the electrical wires are formed substantially perpendicular to a surface of the pressure generating devices.

6. The liquid ejection head as defined in claim 1, wherein the pressure chambers are arranged in a two-dimensional matrix array.

7. The liquid ejection head as defined in claim 1, further comprising a wiring layer which is connected to the electrical wires, the wiring layer being disposed on an opposite side to the pressure generating devices with respect to the common liquid chamber.

8. An image forming apparatus, comprising a liquid ejection head which comprises: a nozzle plate which has a plurality of ejection apertures through which a liquid is ejected; a plurality of pressure chambers which are connected respectively to the ejection apertures; a plurality of liquid supply flow channels which supply the liquid respectively to the pressure chambers; a common liquid chamber which supplies the liquid to the liquid supply flow channels; a plurality of pressure generating devices which respectively deform the pressure chambers; and a plurality of electrical wires which supply drive signals to the pressure chamber generating devices, wherein the electrical wires are provided so as to pass through the common liquid chamber.

9. The image forming apparatus as defined in claim 8, wherein the pressure generating devices are piezoelectric elements.

10. The image forming apparatus as defined in claim 8, wherein:

the pressure generating devices are disposed on an opposite side to the ejection apertures with respect to the pressure chambers; and the common liquid chamber is disposed on an opposite side to the pressure chambers with respect to the pressure generating devices.

11. The image forming apparatus as defined in claim 10, wherein the liquid supply flow channels are formed substantially perpendicular to a surface of the pressure generating devices.

12. The image forming apparatus as defined in claim 8, wherein the electrical wires are formed substantially perpendicular to a surface of the pressure generating devices.

13. The image forming apparatus as defined in claim 8, wherein the pressure chambers are arranged in a two-dimensional matrix array.

14. The image forming apparatus as defined in claim 8, further comprising a wiring layer which is connected to the electrical wires, the wiring layer being disposed on an opposite side to the pressure generating devices with respect to the common liquid chamber.

* * * * *